US005214439A

United States Patent [19]

Reed

[11] Patent Number: 5,214,439

[45] Date of Patent: May 25, 1993

[54] DRUM-DEPLOYABLE MULTIBAY ANTENNA

[75] Inventor: David G. Reed, Southampton Township, Bucks County, Pa.

[73] Assignee: General Electric Company, East Windsor, N.J.

[21] Appl. No.: 631,294

[22] Filed: Dec. 20, 1990

[51] Int. Cl.[5] ..... H01Q 1/12

[52] U.S. Cl. ..... 343/877; 343/792.5

[58] Field of Search ..... 343/877, 797, 823, 880, 343/882, 792.5, 795; 242/54 A

[56] References Cited

U.S. PATENT DOCUMENTS

| | | | |
|---|---|---|---|
| 2,565,661 | 8/1951 | Lidz | 343/877 |
| 3,210,767 | 10/1965 | Isbell | 343/792.5 |
| 3,465,567 | 9/1968 | Park | 343/877 |
| 3,524,190 | 8/1970 | Killion et al. | 343/880 |
| 4,447,816 | 5/1984 | Kurina et al. | 343/877 |
| 4,593,290 | 6/1986 | Wojtowicz | 343/900 |
| 4,977,408 | 12/1990 | Harper et al. | 343/792.5 |

FOREIGN PATENT DOCUMENTS

| | | | |
|---|---|---|---|
| 2109637 | 6/1983 | United Kingdom | 343/823 |

OTHER PUBLICATIONS

"Space Antenna Selection and Design" by Brown et al., published in the Oct., 1965 issue of Systems Design magazine.

*Primary Examiner*—Michael C. Wimer

*Attorney, Agent, or Firm*—William H. Meise; Stephen A. Young; Clement A. Berard

[57] ABSTRACT

A deployable crossed log-periodic dipole array antenna includes a plurality of bays, each associated with four elongated, flexible antenna elements, each element having an S-shaped cross-section for stiffness. Each bay also includes a spool. The spools have a "squared circle" shape adapted to the natural curvature of the antenna elements. A drum surrounds and is coaxial with all the spools, and the antenna elements extend through apertures in the drum. Rotation of the drum winds and unwinds the flexible antenna elements from their spools simultaneously. When the drum begins to wind for retraction of the elements toward a stowed condition, some bays are arranged so that the elements begin to wind about the spools immediately, whereas other bays are arranged so that the antenna elements rotate about hinges over an angle such as 90° or 180° before beginning to wind onto their spools. The spools of the various bays have effective diameters selected to stow and deploy antenna elements of different lengths in response to the same angular rotation of the drum.

16 Claims, 16 Drawing Sheets

DRUM-DEPLOYABLE MULTIBAY ANTENNA

The government has rights in this invention pursuant to Contract Number F04701-89-C-0073 with the Air Force.

BACKGROUND OF THE INVENTION

Among the classes of so-called "frequency independent" antennas are the equiangular antennas and the log-periodic antennas. Log-periodic antennas are so termed because any portion of the structure may be scaled so that the electrical properties repeat periodically with the logarithm of the frequency. In principle, such antennas may be arranged to have any desired bandwidth, but in practice the bandwidth is limited by the manufacturing tolerances possible at the high frequency end, and the low frequency is ordinarily limited by the space required for the low-frequency antenna elements. Frequency-independent and log-periodic antennas are well known in the art and are described, for example, in the text "Antenna Engineering Handbook" edited by Jasik, published by McGraw-Hill.

A particular type of log-periodic antenna is described in U.S. Pat. No. 3,210,767 issued Oct. 5, 1965 to Isbell. The Isbell antenna is a planar (all dipole elements lying substantially in one plane) log-periodic including a number of bays of half-wave dipoles fed by what amounts to an elongated balanced two-wire or two-conductor transmission line. The lengths of the dipole elements taper from a maximum at the low-frequency end to a minimum at the high-frequency or "feed" end.

Those skilled in the art know that antennas are reciprocal passive devices in which various properties are identical in both the transmitting and receiving modes. For example, the directivity and beamwidth are identical in both transmitting and receiving modes of operation. Ordinarily, description of antenna operation is couched in terms of either transmission or reception, the other operation being understood.

When the feed transmission line of the Isbell antenna is fed with signal at a frequency near the center of the operating frequency band from the side of the transmission line having the relatively smaller dipole elements, the signal propagates along the transmission line. When propagating past the relatively small dipole elements near the feed point, the signal "sees" the dipole elements as relatively small capacitances which shunt the effective capacitance of the transmission line. The small radiating elements have relatively small radiation resistance in series with the relatively large reactance of the equivalent capacitance, and therefore radiate very little energy. Thus, the signal effectively propagates along the transmission line unaffected by the small dipole elements. Eventually, the signal reaches regions in which the dipole elements coupled to the transmission line have lengths of approximately $\lambda/4$ ($\lambda/2$ for the entire dipole). In these regions, the propagating signal "sees" real dipole impedances or radiation resistances coupled across the impedance of the transmission line. The dipole impedances are of the same order of magnitude as the characteristic impedance of the transmission line. Consequently, at frequencies at which the dipole elements are approximately $\lambda/2$ long, energy is coupled from the transmission line to the elements and radiated thereby. The log-periodic dipole array is arranged so that more than one dipole receives significant energy at any midband operating frequency, so that an array of elements is formed for radiation at that frequency. The arraying of the elements and their relative phases results in radiation back toward the feed. Thus, a radiated beam is formed in the direction in which the array "points", viewing the array as a whole as an arrowhead pointing in a given direction. If energy were to propagate past the region in which the dipoles are about $\lambda/2$ long, it would encounter dipoles which approach lengths at which they individually produce multiple-lobed patterns and have impedances which couple energy from the transmission lines. However, most of the signal energy applied at the feed point is coupled out within the $\lambda/2$ dipole region, so little energy remains to flow to the relatively large dipoles, the radiation of which might perturb the desired antenna radiation pattern.

As so far described, the Isbell log-periodic dipole produces a singly polarized signal. Antennas of the general type described by Isbell have been used for the horizontally polarized television receiving antennas, for broadband communication and the like. U.S. Patent application Ser. No. 06/936,499 filed Dec. 1, 1986 in the name of Balcewicz describes the simultaneous use of two orthogonal linear polarizations for communication between widely spaced Earth stations. As mentioned in U.S. Pat. No. 4,590,480 issued May 20, 1986 in the name of Nikolayuk et al., singly-polarized or horizontally-polarized signals may not be optimum under all circumstances for television purposes. As mentioned therein, attention has been directed to the broadcasting of circularly polarized signals from a television transmitter in order to reduce the effects of ghosting and to provide uniformity of coverage. Orthogonally crossed log-periodic dipole arrays as described in the article "Space Antenna Selection and Design" by Brown et al., published in the October 1965 issue of Systems Design magazine, have long been known to be useful for simultaneous orthogonal linear polarization or, in conjunction with couplers for providing a quadrature phase shift, for transducing circularly polarized or elliptically polarized signals.

The crossed log-periodic dipole array antenna when fully deployed, as illustrated in the Brown et al. article, includes a transmission line arrangement or "boom" having an axis which lies parallel to the direction of electromagnetic propagation, and also includes two mutually orthogonal $\lambda/2$ dipole antennas at each of multiple bays. The dipole antennas at one end of the array have lengths of about $\lambda/2$ at the highest frequency of operation, and at the other end of the array have lengths of $\lambda/2$ at the low frequency of the operating frequency band. Such an arrangement when in its deployed state may be difficult to mount in position. For example, for VHS television purposes in the United States, each of the two crossed dipoles at the low frequency end of the log-periodic array may be ten or more feet long, and when one of the dipoles is horizontal, the other is vertical. The dipole elements are large and for reliability must be relatively rigid. Such a structure is very awkward to store or manipulate. It is known to hinge each rigid dipole element near its juncture with the transmission line so that the elements fold to a stowed position parallel to the boom, in order to ease the storage problem. However, the problem of awkwardness in handling reappears once it is deployed ready for mounting. An automatic arrangement for deploying an antenna element is desirable, and especially one which is suitable for deploying the elements of a crossed log-periodic dipole array.

A deployable multibay crossed log-period antenna is described in U.S. Pat. No. 4,977,408, issued Dec. 11, 1990, in the name of Harper et al. The Harper et al. antenna includes a pair of crossed two-wire transmission-line feeds, and also includes a plurality of bays. Each bay includes four antenna elements, arranged in pairs as crossed dipoles. The antenna elements therein described are in the form of elongated flat spring-steel elements with a curved or "C-shaped" cross-section, similar to common steel tapes. Each bay includes a spool and a drum rotatable relative thereto. The four antenna elements of each bay are, in a stowed condition of the antenna, wound about the spool of the bay, with energy stored in the spring material. The ends of the elements protrude through apertures in a drum surrounding the spool of the bay, and the elements are prevented from uncoiling from the stowed position by a locking apparatus which locks the drum to its associated spool. When the drum is released so as to be free to rotate, the energy of the coiled antenna elements rotates the drum, and the elements deploy by unwinding from their respective spools. The Harper et al. multibay antenna includes a plurality of such bays. The elements of each bay are wound about the spool of that bay in a direction opposite to that of adjacent bays, because of the need to make element connections to alternate poles of the feed transmission line from one bay to the next. Alternate bays unwind in opposite directions, which helps to reduce torques, which torques may be disadvantageous in a spacecraft application.

For spacecraft applications, reliability considerations make the use of moving contact bushings undesirable. Thus, each drum should be provided with its own bearing set. However, a six-bay antenna would then require six bearing sets, which undesirably adds to the weight of the structure. Also, six drum locking arrangements are required, with an attendant weight and reliability penalty. An improved antenna is desired.

SUMMARY OF THE INVENTION

An antenna includes at least two bays which are associated with a feed transmission line at two separate locations along the transmission line. Each bay includes a spool coaxial with the other spools. An elongated antenna element formed from a spring material is, in the stowed condition, wound about the spool of each bay, with one end of the antenna element electrically connected to a conductor of the feed transmission line. A single drum surrounds and is coaxial with all the spools. Apertures formed in the sides of the drum allow a small portion of the antenna element of each bay to protrude in the stowed condition. The antenna elements are wound about their spools in the same direction, so that all the elements may be deployed by rotation of a single drum. In a particular embodiment of the invention, the spools have different effective diameters so that rotation of the drum through the same angle deploys elements of different bays to different lengths. In another embodiment of the invention, the radius of curvature of the spools is made equal to the natural radius of curvature of the spring antenna element.

DESCRIPTION OF THE DRAWING

FIGS. 5*a* and 5*b* are jointly referred to as FIG. 5;

FIGS. 10*a* and 10*b* are together referred to as FIG. 10;

DESCRIPTION OF THE INVENTION

Figure 1:
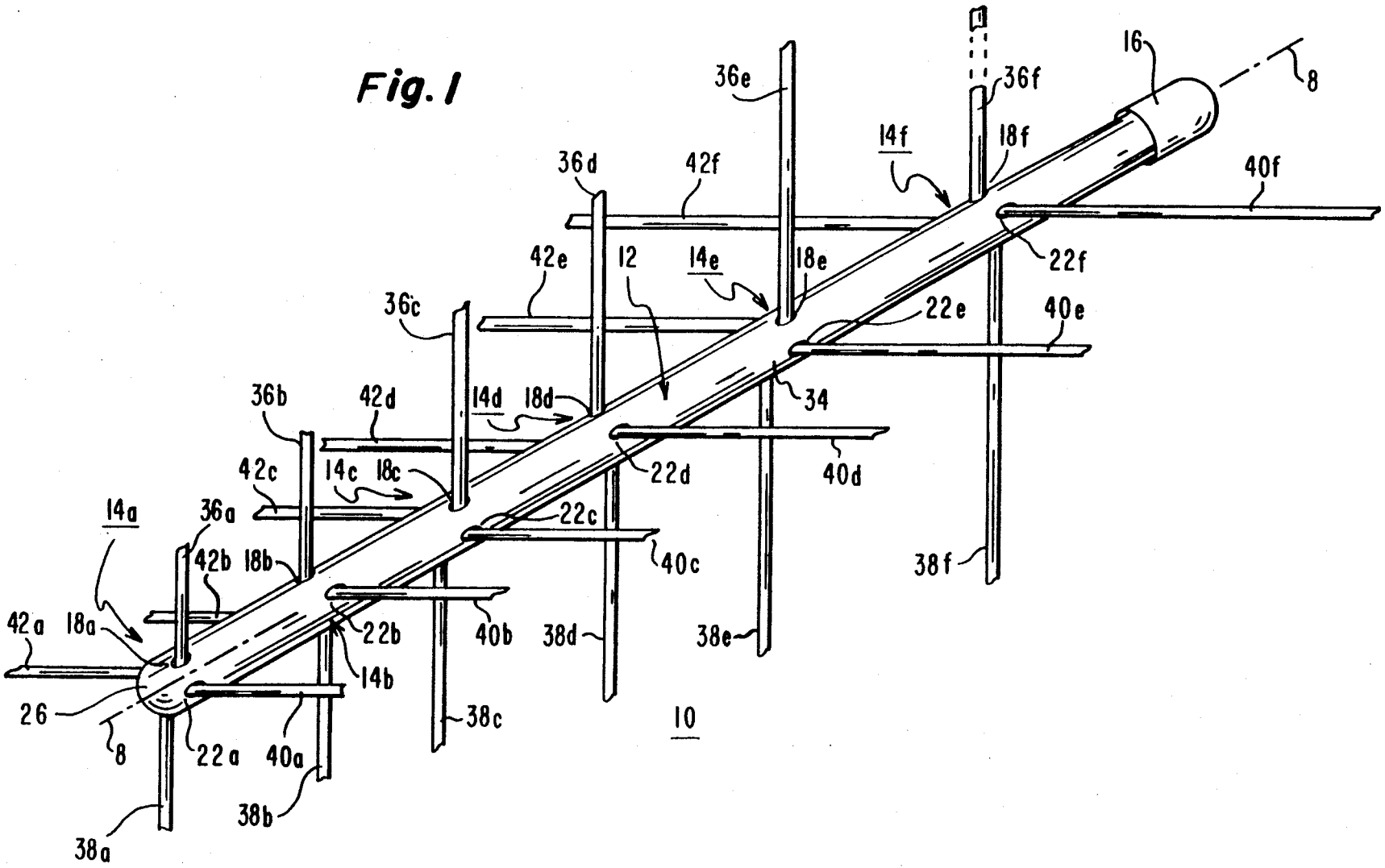
FIG. 1 is a perspective or isometric view of a six-bay crossed log-periodic dipole array according to the invention.

In FIG. 1, a crossed log-periodic dipole array antenna assembly designated generally as 10 includes an elongated electrically nonconductive drum 12 centered on an axis 8. Drum 12 is made from glass fabric filled polyimide resin. Drum 12 surrounds and conceals a support structure which provides signal transmission and mechanical support for six bays 14*a*, 14*b*, 14*c*, 14*d*, 14*e* and 14*f* of antenna 10. At one end of drum 12, a mechanical support and rotation arrangement designated 16 supports the antenna in a cantilevered fashion. The closer, free end 26 of antenna 10 is conventionally termed the "feed" end, although the coaxial cables which provide signals to, and take signals from antenna 10 make connection through support structure 16, as described below.

Bay 14*a* of antenna 10 nearest feed end 26 includes four flexible, elongated, electrically conductive antenna elements. Antenna 10 is illustrated in FIG. 1 in the deployed condition, with the antenna elements fully extended. A vertically disposed, upwardly extending antenna element designated 36*a* extends through an aperture 18*a* in drum 12, and a vertically disposed downwardly extending element designated 38*a* extends through a similar aperture, not visible in FIG. 1. Elements 36*a* and 38*a* coact to form a vertically oriented dipole antenna. As illustrated in FIG. 1, antenna elements 36*a* and 38*a* are not coaxial, but antenna element 36*a* extends upward somewhat to the right of axis 8 (as viewed along the axis), parallel to a vertical line (not illustrated) orthogonal to and passing through axis 8, and antenna element 38*a* extends downward parallel to the same line but somewhat to the left of axis 8. In a similar fashion, an antenna element 40*a* extends through an aperture 22*a* and horizontally to the right parallel to a horizontal line (not illustrated) orthogonal to, and passing through axis 8, and antenna element 42*a* extends to the left slightly above the same horizontal line passing through axis 8. Antenna elements 40*a* and 42*a* coact to form a horizontally disposed dipole antenna.

Bay 14*b* of antenna 10 of FIG. 1 includes a vertically oriented antenna element 36*b* extending vertically through an aperture 18*b* in drum 12, slightly to the left of a vertical line passing through axis 8, and a second vertically oriented antenna element 38*b* extending downward slightly to the right of the vertical line passing through axis 8. Antenna elements 36*b* and 38*b* coact to form a vertically oriented dipole antenna. In a similar fashion, antenna element 40*b* extends through an aperture 22*b* in drum 12, horizontally to the right, slightly above a horizontal line passing through axis 8, and antenna element 42*b* extends horizontally to the left slightly under the horizontal line passing through axis 8. In accordance with log-periodic principles, each antenna element of bay 14*b* is somewhat longer than the corresponding element of bay 14*a*.

By observing FIG. 1, it can be seen that vertically-oriented antenna elements 36*c* and 38*c* of bay 14*c* are oriented to the right and left, respectively, of a vertical line passing through axis 8, much like antenna elements 36*a* and 38*a* of bay 14*a*. Similarly, antenna elements 40*c* and 42*c* extend horizontally to the right and left slightly below and above, respectively, a horizontal line passing through axis 8, much the same as antenna elements 40*a* and 42*a*, respectively, of bay 14*a*. Comparison of the element locations of FIG. 1 reveals that alternate bays are similar (except for length), and thus bays 14*a*, 14*c* and 14*e* are similar, and bays 14*b*, 14*d* and 14*f* are similar. Each antenna element extends through an appropriate aperture in drum 12.

Figure 2:
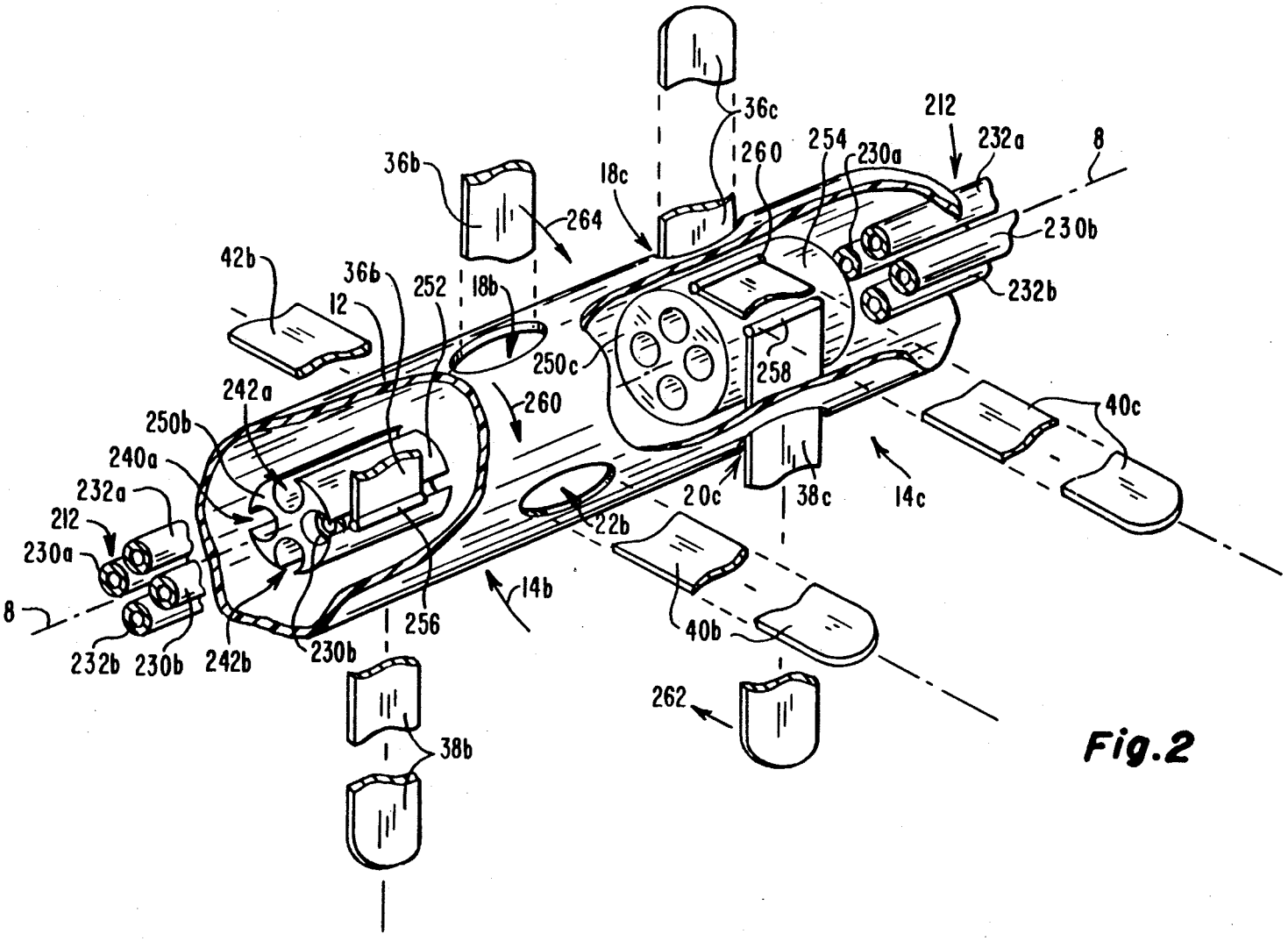
FIG. 2 is a perspective or isometric view, partially exploded and partially cut away to illustrate interior details, of two bays of an embodiment of the invention.

FIG. 2 illustrates details of two bays of an embodiment of the invention. Elements of FIG. 2 corresponding to those of FIG. 1 are designated by the same reference numerals. In FIG. 2, a feed arrangement 212 includes two pairs of two-conductor electrical transmission lines. A first two-conductor transmission line includes an elongated, electrically conductive, i.e., aluminum, upper tube 232*a* extending parallel to and slightly above axis 8, coacting with a corresponding lower tube 232*b* located parallel to and below axis 8. A similar horizontally disposed transmission line includes elongated tubes 230*a* and 230*b*, running parallel to and centered on axis 8. Such two-conductor transmission lines are in common use for feeding crossed log-periodic dipole arrays, and require no further explanation. As illustrated in FIG. 2, bay 14*b* includes an electrically nonconductive cylindrical spool 250*b* having a cylindrical outer surface 252 lying at a predetermined radius from axis 8. Spool 250*b* is supported by tubes 232*a* and 232*b* extending through apertures 242*a* and 242*b* in the spool, and by tubes 230*a* and 230*b* extending through apertures 240*a* and 240*b*. Similarly, bay 14*c* of FIG. 2 includes a nonconductive spool 250*c* having a cylindrical outer surface 254 centered at a predetermined radius from axis 8. The diameter of spool 250*c* is greater than the diameter of spool 250*b*, so the circumference of surface 254 is greater than the circumference of surface 252. Spool 250*c* is held in place by tubes 230*a* and 230*b* and 232*a* and 232*b* extending through apertures therein (not separately designated).

As illustrated in FIG. 2, flexible antenna element 36*b* has one end affixed by a hinge 256 to the outer surface 252 of spool 250*b*. The axis of rotation of hinge 256 is parallel to axis 8. Although not illustrated in FIG. 2, the other antenna elements associated with bay 14*b*, namely elements 38*b*, 40*b* and 42*b*, also have their ends affixed by hinges to outer surface 252 of spool 250*b*. Antenna element 36*b* is affixed to spool 250*b* adjacent to tube 230*b*, for ease of connection of the antenna element to the feed conductor. Antenna elements 38*b*, 40*b* and 42*b* have their ends affixed to spool 250*b* by hinges adjacent tubes 230*a*, 232*b* and 232*a*, respectively, for the same reason. Details of the electrical connections are not illustrated in FIG. 2.

In FIG. 2, spool 250*c* of bay 14*c* has antenna elements 38*c* and 40*c* connected to its outer surface by hinges 258 and 260, respectively. Antenna element 38*c* is connected to outer surface 254 of spool 250*c* adjacent the location at which tube 230*b* extends through the spool, and antenna element 40*c* is affixed to outer surface 254 of spool 250*c* adjacent the location at which tube 232*a* extends through the spool. Making the connections adjacent the feed element facilitates the electrical connections required for proper feed of the log-periodic dipole array.

Referring once again to FIG. 2, it will be noted that upwardly extending antenna element 36*b* and downwardly extending antenna element 38*c* are both affixed to their respective spools adjacent to tube 230*b*. Thus, each of antenna elements 36*b* and 38*c* are mounted so as to be driven from the same feed conductor. However, antenna element 36*b* extends vertically upward, while antenna element 38*c* extends vertically downward. Thus, the log-periodic feed requirements are satisfied.

As described in greater detail below, spools 250*b* and 250*c* remain in a fixed position during deployment and stowing operations, while drum 12 rotates coaxially thereabout. In accordance with an aspect of the invention, smaller diameter spools such as 250*b* are associated with shorter antenna elements, while larger diameter spools such as 250c are associated with longer elements. Thus, the same amount or angle of rotation of drum 12 about axis 8 can deploy antenna elements of different lengths to their full extent. This is accomplished by making the effective circumference of each spool proportional to the length of the antenna element to be deployed. The effective circumference takes into account the fact that when four antenna elements are wound on a spool, the winding radius begins to increase after only one quarter turn, as elements wind upon other elements. This increases the diameter of the structure upon which each element winds to a greater diameter than the actual diameter of the spool.

When the antenna elements of antenna 10 of FIG. 1 are stowed or retracted (condition not illustrated), only a small portion of each element extends through the corresponding aperture in drum 12. In the stowed condition, the protrusion of the antenna element may be the same for all bays, regardless of the deployed length.

In accordance with another embodiment of the invention, rotation of drum 12 causes all antenna elements to be wound in the same direction about their respective spools. Thus, clockwise rotation of drum 12 (as viewed from the left along axis 8 in FIG. 2, in the direction of arrow 2601 of FIG. 2) causes clockwise winding of the antenna elements onto their respective spools. Clockwise rotation of drum 12 causes winding of antenna element 38c about drum 250c in the direction of arrow 262. Similarly, clockwise rotation of drum 12 causes antenna element 36b to wind about drum 250b in the direction of arrow 264. If antenna element 36b were rigidly affixed to spool 250b, an attempt to wind the antenna element about the spool might result in kinking or bending damage to the antenna element. However, according to an aspect of the invention, the antenna element is enabled for rotation about hinge 256 so that, as the drum rotates, some of the antenna elements smoothly rotate 180 degrees about their hinges, and then begin to wind about their spools. Other antenna elements may not need to rotate about hinges before winding begins.

Referring once again to FIG. 2, it can be seen that the antenna elements are in the form of thin, elongated structures which have a curved cross-section in the deployed condition. Prior art arrangements have antenna elements with a cross-section (viewed along the axis of elongation of the element) which is similar to a portion or segment of a circle. In accordance with an aspect of the invention, the antenna elements are stiffened by a cross-section which is a bipartite curve with a point of inflection therebetween. Thus, one portion of the curve of the cross-section has a radius (or radii) of curvature centered on one side of the element, while the other curve of the cross-section has a radius (ii) of curvature centered on the other side of the element, as described in more detail in conjunction with FIG. 9b. An antenna element with such a cross-section is termed "S-shaped" for ease in description. It has been found that such an S-shaped cross-section provides greater stiffness of the element than a "C" cross-section, which greater stiffness may be advantageous for long elements.

Figure 3B:
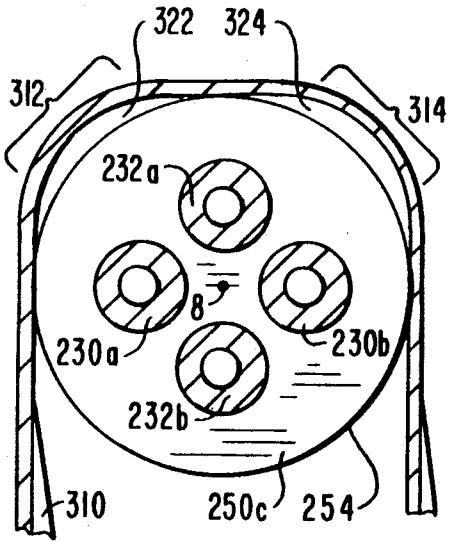
FIGS. 3*a* and 3*b* illustrate how a flexible antenna element winds about spools of different diameters.
Figure 3A:
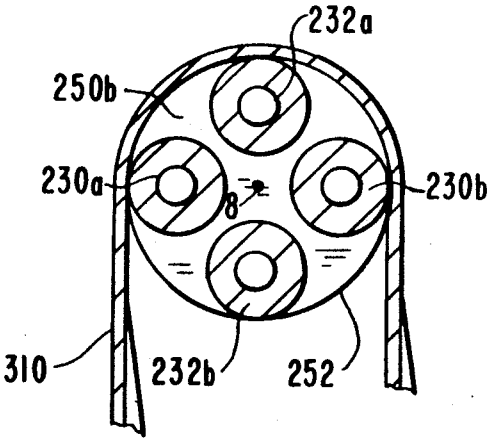

When an embodiment of the invention similar to FIG. 2 was being made, it was expected that the relatively stiff S-shaped antenna elements would wind easily about the larger-diameter spools, but that some difficulty might be experienced in winding the S-shaped element about the smaller spools. It was then discovered, contrary to expectations, that the S-shaped elements wound more easily around the smaller-diameter spools than C-shaped elements. It was found that the natural radius of curvature of an element is inversely related to its stiffness, and thus the radius of curvature of the stiffer S-shaped element is less than that of the "C" cross-section element. FIG. 3a illustrates smaller-diameter spool 250b of FIG. 2 with an S-shaped element 310 wound smoothly thereabout. It should be noted that the "S" curvature of the crosssection tends to become flat when the element is bent in a curve as illustrated in FIG. 3a, so the element can lie flat against outer surface 252. FIG. 3b illustrates the lie of the tape when the spool diameter is larger. As illustrated in FIG. 3b, the tape assumes a segmented curve, including regions such as 312 and 314, in which the curvature is sharp or has a small radius of curvature, and other regions therebetween in which the element is about straight, which may be viewed as a large radius of curvature. The net effect is to form a "squared circle" shape, with curved portions of the antenna element lifted away from the cylindrical surface 254 of the spool to define apertures or gaps 322, 324. According to an aspect of the invention, the spool shape is adapted to the "squared circle" shape which the wound antenna elements exhibit. The apparent enlargement or thickening of elements 310 at locations remote from the spools is explained below.

Figure 4A:
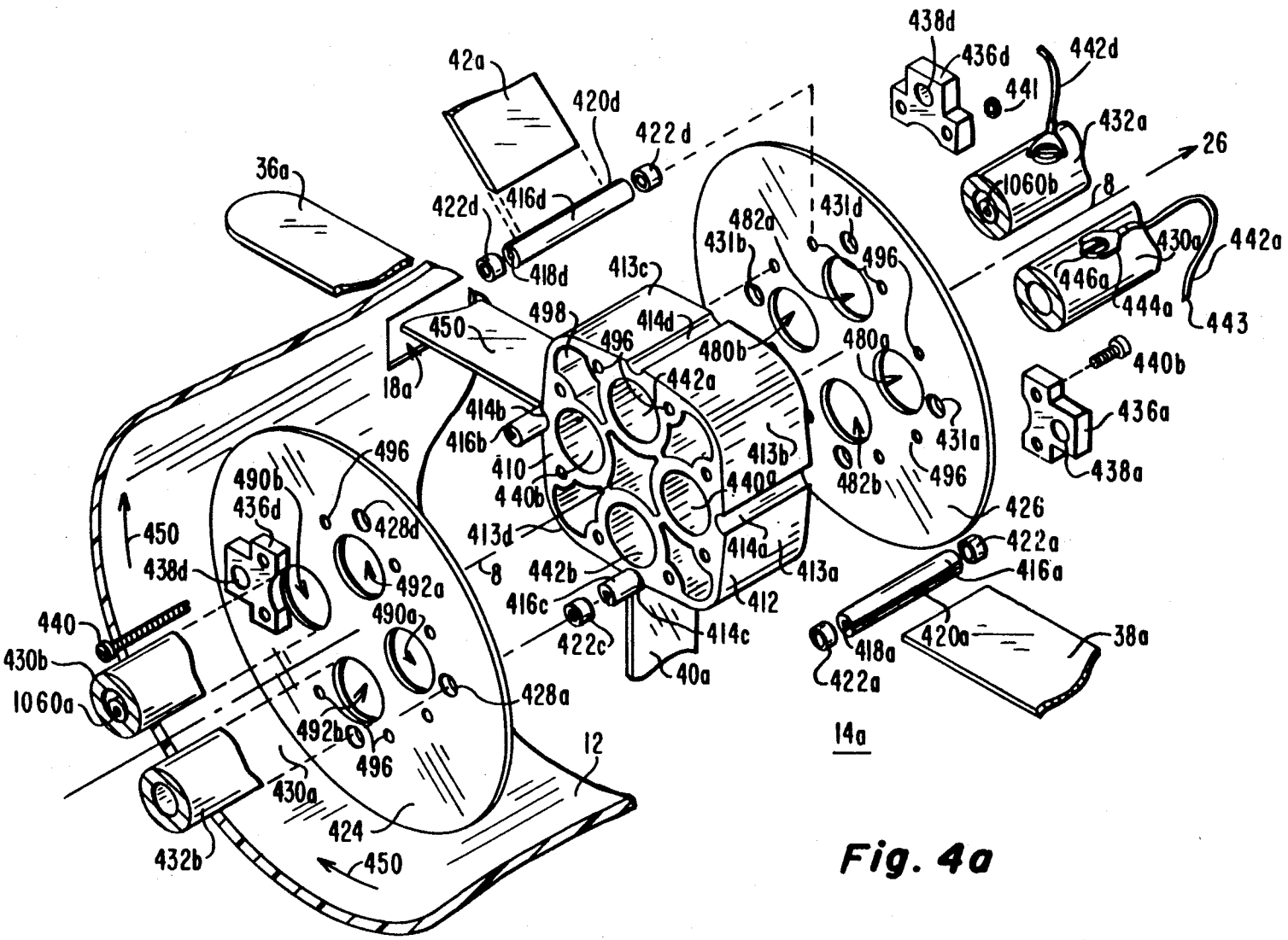
FIG. 4*a* is a perspective or isometric view, partially exploded and partially cut away to illustrate interior details, of a bay of an embodiment of the invention, in which the spool has regions with differing (larger and smaller) radius of curvature, and in which the flexible antenna elements may be wound either clockwise or counterclockwise, so that the bay of FIG. 4*a* may be used in either of two bay locations of FIG. 1, with appropriate scaling of the effective spool diameter.

FIG. 4a illustrates details of a bay of the antenna of FIG. 1 which may be used for short antenna elements, and which might therefore be useful for either of bays 14a or 14b of FIG. 1, according to an aspect of the invention. For definiteness, FIG. 4a is described as applicable to bay 14a. Elements of FIG. 4a corresponding to those of FIG. 1 are designated by like reference numerals. In FIG. 4a, four electrically conductive tubes 430a and *b*, 432a and *b* are illustrated, which are portions of two pairs of crossed two-conductor transmission lines, similar to those of FIG. 2, which extend parallel to axis 8. The view of FIG. 4a is such that the antenna feed end 26 is to the right rear, and the bays with larger elements, and support structure 16, are to the left fore.

A spool 410 in FIG. 4a is made from a nonconductive composite material such as G-10 glass-epoxy laminate, and has a "squared-circle" outer surface 412 including portions 413a, *b*, *c* and *d* with relatively small radii of curvature, separated from each other by regions (not separately designated) with relatively larger radii of curvature (flatter regions). Centered in each region with a large radius of curvature is a notch 414, which has a cross-sectional shape which is a portion of a circle which is less than a semicircle. Spool 410 is supported by tubes 430a and *b* and 432a and *b*, which extend through circular clearance holes 440a and *b* and 442a and, *b*, respectively. Holes such as 498 reduce the mass of the spindle.

A beryllium-copper hinge pin 416a in FIG. 4a has a central bore 418a extending axially therethrough, and a slot 420a extending radially from bore 418a to the outer surface. As illustrated, an end of antenna element 38a fits into slot 420a. The antenna element is affixed to pin 416a, as by welding. Pin 416a fits into notch 414a. Pin 416a is longer than notch 414a, and extends beyond the sides of spool 410. A pair of nonconductive bushings 422a fit over those portions of pin 416a which extend beyond the sides of spool 410. The interior diameter of each bushing 422 is slightly greater than the diameter of a hinge pin 416, so that hinge pin 416 may rotate in the bushing.

A pair of flat, circular side flanges 424 and 426 are made from nonconductive composite material, which may also be G-10 glass fiber-epoxy laminate. Flange 424 defines four clearance holes 490*a* and *b*, and 92*a* and *b*, which are registered with holes 440*a* and *b*, and 42*a* and *b*, respectively, in spool 410. A similar registered set of holes 480*a* and *b*, and 482*a* and *b*, is defined in flange 426. Each of flanges 424 and 426 also includes a set of assembly screw clearance holes 496, not all of which are designated, which are registered together and with a corresponding set of holes 496 in spool 410. Each of flanges 424 and 426 also includes a set of four hinge pin clearance holes, designated 428 *a–d* (where the hyphen represents the word "through"), and 431*a–d*, which are registered in part with notches 414.

When side flanges 424 and 426 are assembled to the sides of spool 410, the ends of hinge pin 416*a* and bushings 422*a* extend through holes 428*a* and 430*a* in flanges 424 and 426, respectively, to retain pin 416*a* in place, thereby captivating antenna element 40*b*, while allowing its rotation about the axis of pin 416*a*. As described below, flanges 424 and 426 are held to spool 410 by screws, and the hinge pins are provided with further support.

Figure 4C:
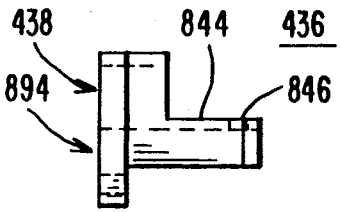
FIGS. 4*b*, 4*c*, 4*d* and 4*e* are isometric or perspective side elevation, and frontal, elevation and plan views, respectively, of a fitting useful in FIG. 1*a*, FIGS. 4*a*–4*e* are referred to jointly as FIG. 4.

The other antenna elements in FIG. 4*c* are similarly fitted into slots in their associated hinge pins and are affixed thereto, bushings are mounted onto the hinge pins, and assembled so as to be captured between flanges 424 and 426. For example, element 42*a* is fitted into slot 420*d* of hinge pin 416*d* and affixed by welding. Pin 416*d* is fitted into notch 414*d* in a flatter portion of outer surface 412 of spool 410. Bushings 422*d* are placed on the protruding ends of hinge pin 416*d*. When assembled, the protruding ends of pin 416*d*, with bushings, extend through holes 428*d* and 430*d* in flanges 424 and 426, respectively. Antenna element 36*a* is affixed to hinge pin 416*b*, which fits into slot 414*b*. The ends of pin 416*b* protrude (with bushings, not illustrated) through hole 431*b* in flange 426 and through a corresponding hole (not visible) in flange 424.

The ends of hinge pins 416 of FIG. 4*a* are supported for rotation by fittings 436, only some of which are illustrated in FIG. 4*a*. For example, the near end of hinge pin 416*b* extends through flange 424 into a hole 438*d* in an anodized aluminum fitting 436*d*, affixed to the outer side of flange 424. The far end of hinge pin 416*d*, with its bushing 422*d*, extends through hole 431*d* in flange 426, and into a hole 438*d* in a fitting 436*d*. Similarly, the far end of hinge pin 416*a* with its bushing 422*a* extends through hole 431*a* in flange 426 into a hole 438*a* in fitting 438*a*. Fittings 436 are fastened to the exterior of the associated flanges by screws, such as screw 440, which pass through registered clearance holes in a first fitting 436, a flange 424, and are threaded into helical coils (not illustrated) set into spool 410. As an alternative, longer screws could be used, which would also pass through further holes in flange 426, and through a second fitting 436, to be retained by a nut such as 441.

Figure 4B:
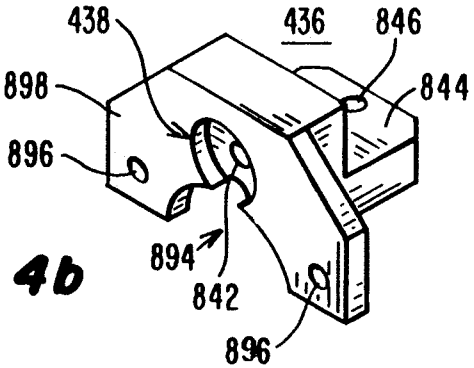
Figure 4E:
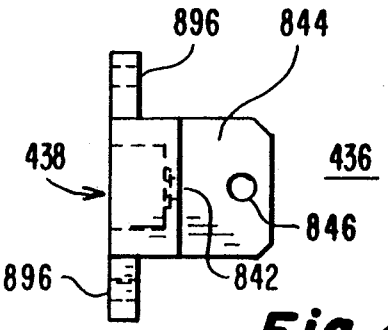
Figure 4D:
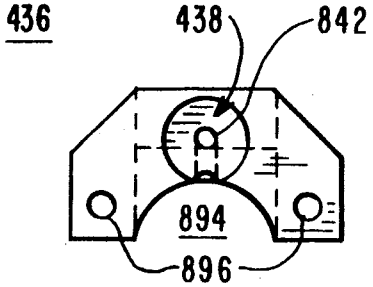

FIGS. 4*b–e* are more detailed views of fittings 436 of FIG. 4*a*. Elements of FIGS. 4*b–e* corresponding to those of FIG. 4*a* are designated by like numerals. For definiteness, the fitting of FIGS. 4*b–e* is described as though it were fitting 436*a* of FIG. 4*a*, although the comments are applicable to other fittings. In FIGS. 4*b–c*, a flat face 898 of fitting 436 is adapted to be placed flat against the exterior of flange 424 of FIG. 4*a*. A partial-cylindrical bore 894 is dimensioned to fit over and snugly against tube 430*a* of FIG. 4*a*. A screw clearance hole 846 is located so as to lie over a threaded hole in tube 430*a* of FIG. 4*a*, and is adapted to clear retaining screw 446*a* of FIG. 4*a*. Retaining screw 446*a* and other similar retaining screws locate and retain fittings 436, flanges 424 and 426, and spool 410 at the desired location along the length of tubes 430*a* and *b* and 432*a* and *b*. A flat surface 844 adjacent screw clearance hole 846 in FIGS. 4*b–4e* is a convenient support for spade lug 444*a* (FIG. 4*a*). A pair of screw clearance holes 896 are spaced and registered together and with bore 894 so that, when mounted upon and fastened to tube 430*a* by screw 446*a*, a pair of screws, one of which is illustrated as 440*b* in FIG. 4, can pass through hole 896 and a hole 496 in flange 426, to be threaded into a helical coil (not illustrated) inserted into a corresponding hole in spool 410, as described above. Fitting 436 also includes a bore 438 extending perpendicular to face 898 to a depth selected to provide a slight end float of hinge pin 416*a* of FIG. 4. At the end of bore 438, a small hole 842 in an end wall 843 provides clearance for a flexible conductor, described below. The diameter of bore 438 is slightly greater than the diameter of bushing 422*a* of FIG. 4*a*, so that bushing 422 can rotate within bore 438. Thus, if hinge pin 416*a* were to freeze to bushing 422*a*, rotation could still occur by rotation of bushing 422*a* in bore 438, or vice versa, to thereby avoid a single-point failure. This increases the reliability of the system.

As so far described, the structure of FIG. 4 has the electrically conductive assembly of a hinge pin such as 416*a* and antenna element 42*b* making no direct electrical contact with fitting 436*a*, because of nonconducting bushing 422*a*, and also because of the end float. Electrical contact between feed conductor or tube 430*a* and hinge pin 416*a* is made by means of a flexible stranded or braided conductive wire 442*a*, an end 443 of which extends through hole 842 in fitting 436*a* and into bore 418*a* of hinge pin 416*a* and is brazed thereto, and the other end of which terminates in a spade lug 444*a*, which may be captured between the head of a screw 446*a* and flat surface 844 of fitting 436*a* as the screw is turned into the side of tube 430*a*. A similar wire 442*d* is connected at one end into bore 418*d* extending through pin 416*d*, while the other end is electrically connected by way of a spade lug, fitting and screw to tube 432*a*. The flexible wire allows the antenna element to freely move about the hinge pins.

In accordance with well-known crossed-dipole principles, antenna element pair 36*a*, 38*a* is fed with mutually out-of-phase signals by electrical connection to the transmission line defined by tubes 430*b* and *a*, respective, and antenna elements 42*a* and *b* are driven with mutually out-of-phase signals by electrical connections to the transmission line defined by tubes 432*a* and *b*, respectively.

The elements and spool illustrated in FIG. 4 are neither fully deployed nor fully stowed, but are in an intermediate condition in which the elements are unwound, but in which drum 12 is continuing to rotate in a counterclockwise direction as viewed from feed end 26 (rotation in the direction of arrows 450 in FIG. 4) to deploy the elements. From the illustrated condition, drum 12 must continue to rotate about axis 8 for about another 90°, whereupon antenna element 36*a* will project vertically upward, with a portion of upper surface 452 of element 36*a* against outer surface 412 of spool 410. At the same time, antenna element 38a will project down, and elements 40a and 42a will project to the right and left, respectively, of axis 8 as viewed from feed end 26.

From the fully deployed condition described above for FIG. 4a (antenna element 36a projecting straight up, element 38a straight down), drum rotation can cause the elements to retract toward a stowed condition. This may be accomplished by rotating drum 12 counterclockwise as viewed from the feed end (a direction opposite to arrow 450 of FIG. 4a). During the first 180° of rotation, the antenna elements do not wind about spool 410, but merely rotate about their respective hinges. Thus, antenna element 36a rotates from a vertically upwardly extending to a downwardly extending condition, and then contacts the side of spool 10 to begin winding about sharply curved portion 413d. The other elements likewise rotate 180° about their hinges in consonance with rotation of drum 12, and then begin to wind about the spool.

If the structure of FIG. 4 is used in the position of the second bay (bay b of FIG. 1) the elements assume different fully deployed positions. In particular, the antenna element illustrated as element 38a in FIG. 4 (which would be designated 38b for bay b but which is described herein with the actual designation of FIG. 4) would project vertically upward in the fully deployed condition, while antenna element 36a would project vertically downward. Similarly, antenna element 42a would project horizontally to the left (to the right in the position illustrated for antenna element 40b in FIG. 1), and antenna element 40 would project horizontally to the right (to the left in the position assumed by antenna element 42b in FIG. 1). Such deployment directions, while maintaining the same transmission-line connections, fulfill the requirements for a log-periodic dipole array, in which the phase of the feed reverses from bay to bay.

Figure 5A:
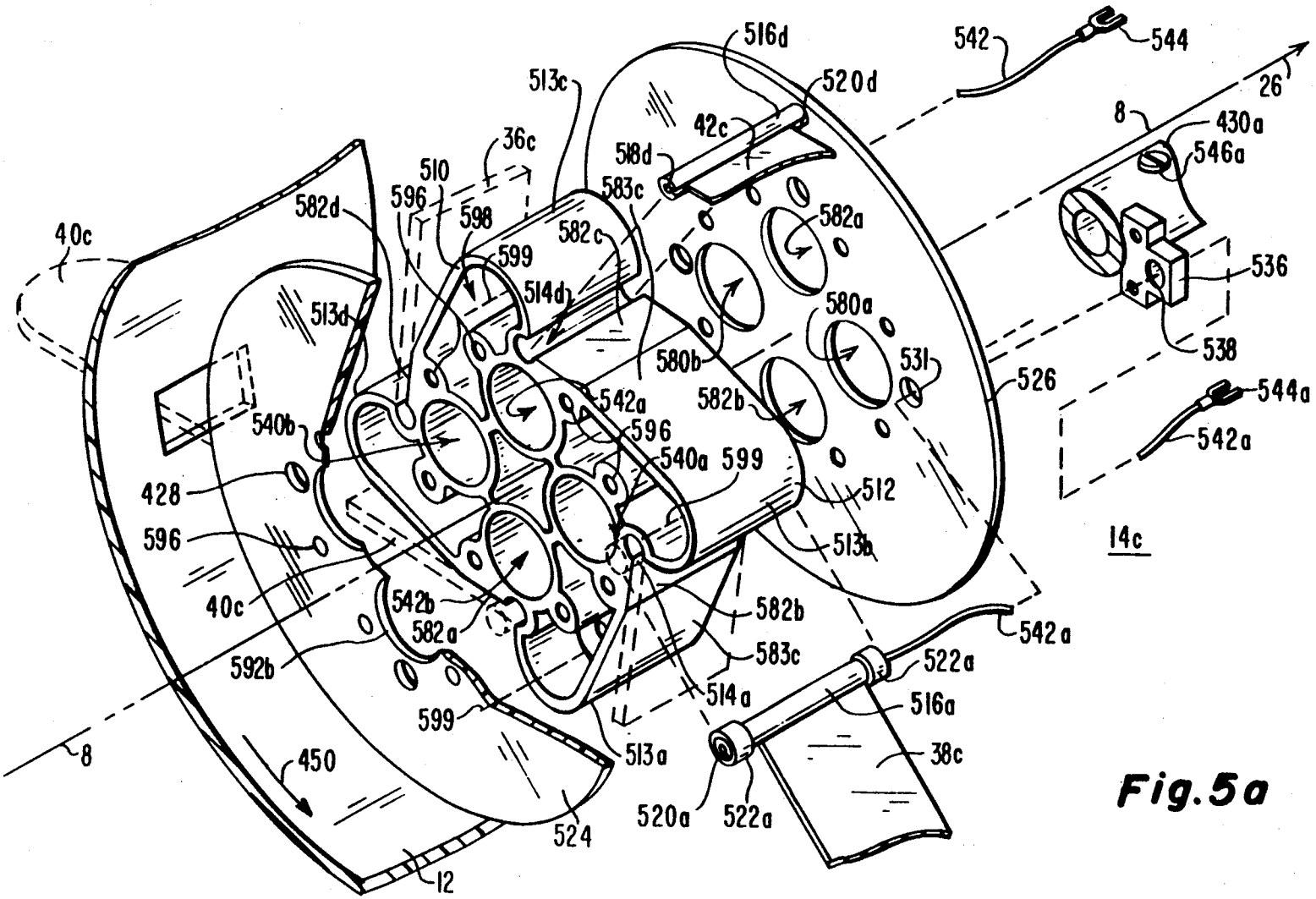
FIG. 5*a* is a perspective or isometric view, partially exploded and partially cut away to illustrate interior details, of another bay which may be used in FIG. 1 in an embodiment of the invention, in which the spool has a larger effective diameter than the spool of FIG. 4 for deploying or unfurling longer spring dipole elements.

FIG. 5a illustrates details of bay 14c of the antenna of FIG. 1. Elements of FIG. 5a corresponding to those of FIGS. 1 and 4 are designated by like reference numerals. The structure of FIG. 5a is generally similar to that of FIG. 4, so elements having the same function as those of FIG. 4 are designated by the same reference number in the 500 series rather than in the 400 series. Spool 510 of FIG. 5a is supported by tubes 430a and *b* and 432a and *b* (only tube 430a illustrated) passing through apertures 540a and *b* and 542a and *b*. The antenna elements are welded into slots in the hinge pins, as in FIG. 4. For example, antenna element 38c is welded into slot 520a in hinge pin 516a, and antenna element 42c is welded into slot 520d in hinge pin 516d. The hinge pins extend beyond the sides of spool 510, and are fitted with bushings 522, which extend into bores 538 in fittings 536 (only one fitting illustrated) as described in conjunction with FIG. 4. Flexible wires 542 are connected at one end into bore 520 in the hinge pins, and terminate at the other ends in spade lugs 544, adapted to be placed under the heads of screws 546 to provide electrical connection between the antenna elements and the feed tubes.

Figure 5B:
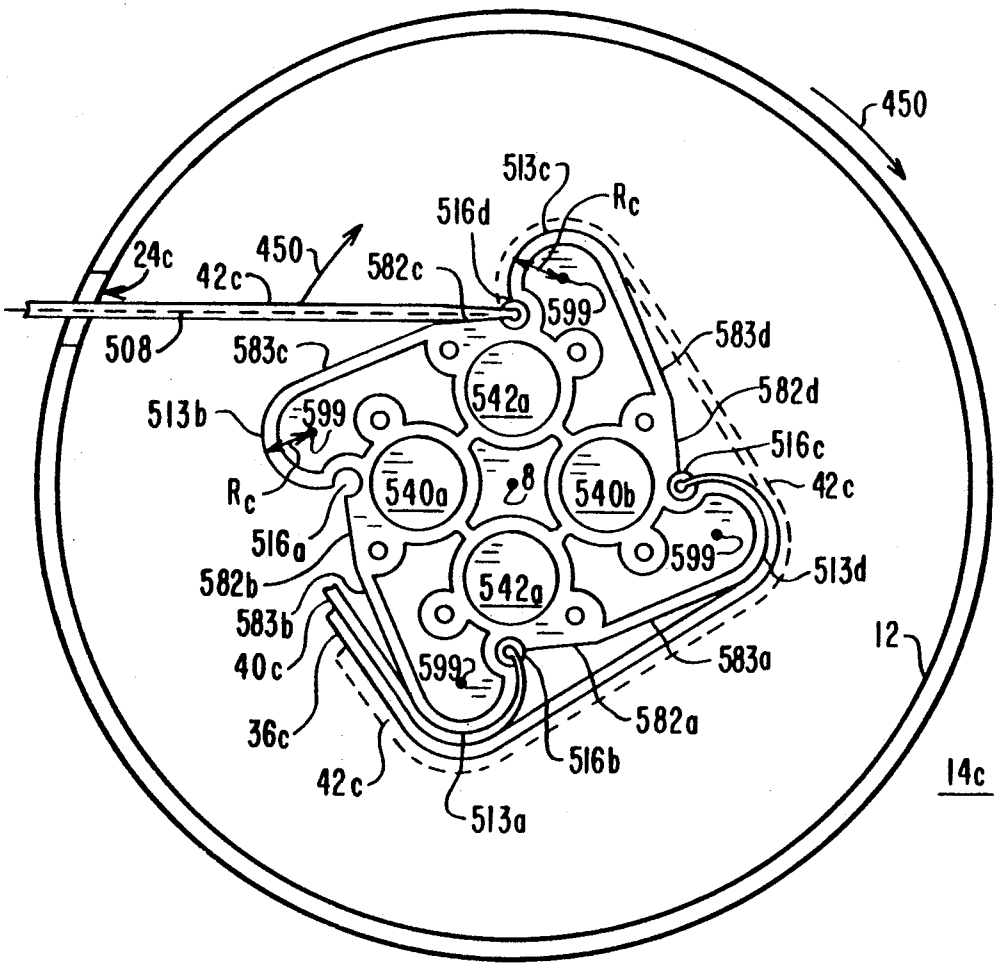
FIG. 5*b* is a plan view of the spool of FIG. 5*a* seen from the antenna feed end, with some spring antenna elements associated therewith.

The shape of spool 510 of FIG. 5a differs from that of spool 410 of FIG. 4. In particular, spool 510 has a larger effective diameter. In order to prevent the problem described in conjunction with FIG. 3a, spool 510 has sharply curved (small radius of curvature) areas 513a–d. Between sharply curved areas 513 are straight (large radius of curvature) regions 582a–d and 583a–d, more visible in FIG. 5b. In the deployed condition of the antenna, straight sections 582 of outer surface 512 of spool 510 lie near a plane extending between the center of the adjacent hinge pin and the center of an aperture in drum 12. In effect, surfaces 582 are a "support" or "bottom" which defines the direction in which the associated antenna element projects in the fully deployed condition. Thus, surface 582c provides a support for element 42c, so that it may project to the left somewhat above axis 8 as illustrated in FIG. 5b. As illustrated in FIG. 5b, the thickness of antenna element 42c appears to be relatively large where it passes through drum aperture 24c, tapering to a lesser thickness near hinge pin 516d. As described below in conjunction with FIG. 9, this results from compression of cross-sectional curvature of the antenna element where it joins the hinge pin. Support surface 582c and other support surfaces described herein are adjusted so that the antenna element projects in the selected direction when fully deployed. In particular, the angle of surface 582c is depressed a few degrees below the horizontal so that the axis of elongation 508 of antenna element 42c is horizontal. Similarly, surface 582b provides a support for antenna element 38c, surface 582a supports element 40c, and surface 582d supports antenna element 36c.

As illustrated in FIG. 5, the curvatures of sharply curved portions 513 of surface 512 of spool 510 are centered on axes 599, and the corresponding radius of curvature $R_c$ is selected to match the natural curvature of the antenna elements. The axes (not illustrated) of hinge pins 516 are also centered at distance $R_c$ from points 599, so that when stowing of the antenna begins by clockwise rotation of drum 12 (the direction of arrow 450 in FIGS. 5a and 5b), the antenna elements rotate smoothly about their hinges through an angle of about 90° until coming into contact with the sharply curved surfaces of the spool, and immediately thereafter begin to wind about the spool with the proper radius of curvature. Straight surfaces 583 play no functional role, but merely connect the sharply curved surfaces to the adjacent support surfaces 582 at a point below the wound antenna elements. For example, FIG. 5b illustrates antenna element 42c by solid lines in its deployed condition, and illustrates by dotted lines a portion of antenna element 42c in its wound state. In the stowed condition, antenna element 42c extends from the peak of sharply curved surface 513c to the peak of sharply curved surface 513d. Surfaces 583d and 582d must intersect below antenna element 42c to prevent interference.

During stowing of the antenna array from the fully deployed condition by winding the antenna element onto the spools, each antenna element first winds onto the spool, as indicated by element 42c winding onto surface 513c in FIG. 5b, but further winding causes the antenna elements to wind onto each other to form an interleaved winding. Thus, continued progression toward a stowed condition causes element 42c to wind onto element 36c, which in turn winds onto element 40c. Thus, the effective diameter of the spool is other than might be expected from simply measuring the distance across the peaks of the sharply curved portions.

Figure 6:
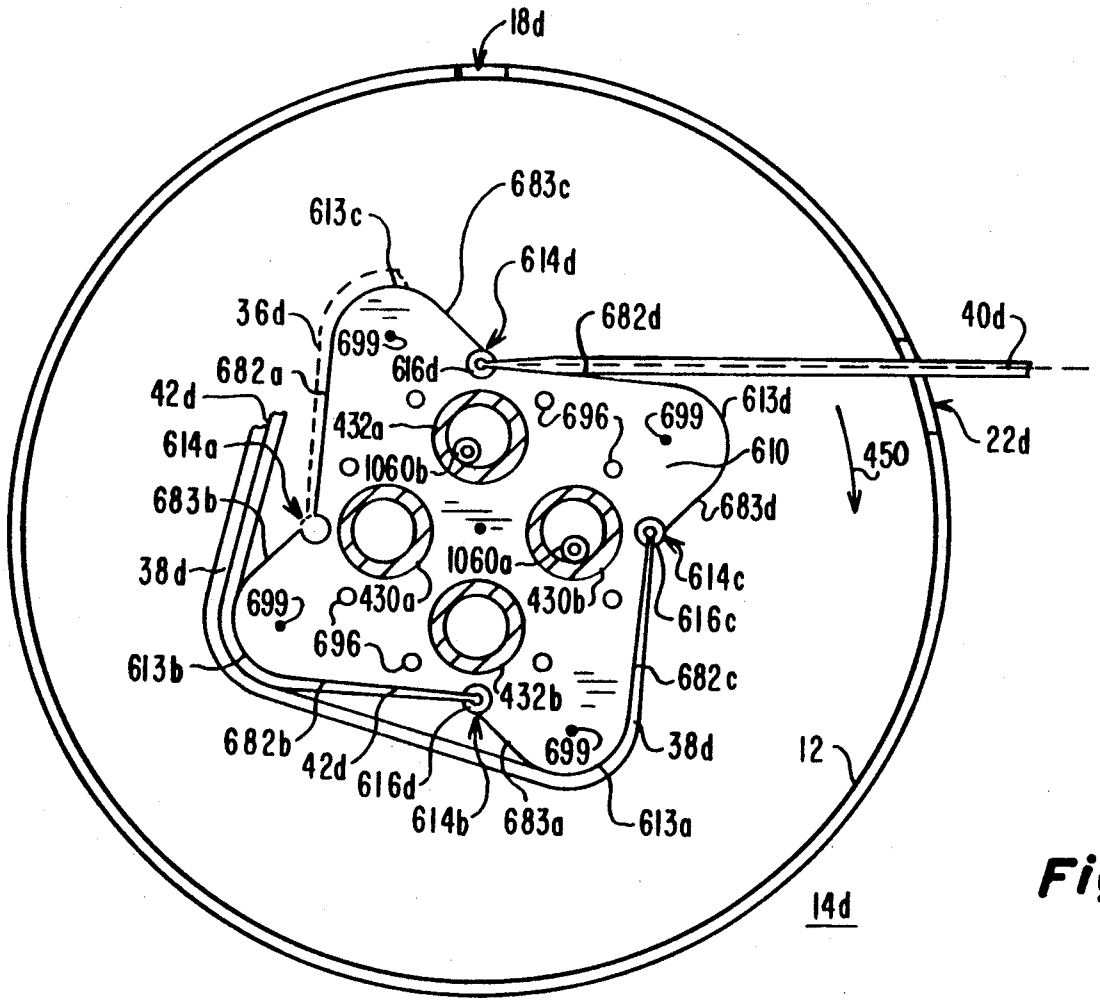
FIGS. 6 and 7 are simplified axial views, from the feed end, of the spools of the fourth and fifth bays of FIG. 1, in an embodiment of the invention, with some spring antenna elements associated therewith.

It will be noted that spools 410 of FIG. 4 and 510 of FIGS. 5a and 5b both relate to odd-numbered bays (first bay 14a and third bay 14c), and the antenna elements extend from the spool in the same relationship relative to axis 8. FIG. 6 is a simplified axial view from feed end 26 of the spool for bay 14d, in which the antenna elements extend in the opposite direction relative to axis 8 by comparison with bays 14a and *c*. In FIG. 6, elements corresponding to those of FIGS. 1, 4 and 5 are designated by the same reference numeral, and different elements having the same function are designated by the same numeral in the 600 series.

In FIG. 6, squared-circle spool 610 is supported by tubes 430*a* and *b* and 432*a* and *b* extending therethrough. The outer surface of spool 610 includes sharply curved portions 613*a–d* centered on points 699. Long straight regions 682 extends between sharply curved surfaces 613 and the adjacent notch 614, while a shorter straight region 683 extend in a similar manner on the other side of each curve. Thus, a straight region 682*a* extends from notch 614*a* to intersect sharply curved portion 613*c*, and another, shorter straight portion extends from the other side of sharply curved portion 613*c* to notch 614*d*. Straight surfaces 682*d* and 683*d* are associated with curved portion 613*d*, straight portions 682*c* and 683*a* with curved portion 613*a*, and straight portions 682*b* and 683*b* with curved portions 613*b*. Notches 614*a–d* are centered at extensions of the curvature centered on points 699. Each notch is adapted to receive a hinge pin 616, as for example hinge pins 616*b, c* and *d* are located in notches 614*b, c* and *d*, respectively. Each hinge pin is affixed to an antenna element, as antenna elements 42*d*, 38*d* and 40*d* are affixed to hinge pins 614*b, c* and *d*, respectively. Antenna element 40*d* is illustrated in the deployed condition, lying against surface 682*d*, and its winding direction is illustrated by arrow 450. Antenna elements 36*d*, 38*d* and 42*d* are illustrated in a partially wound or stowed condition. Of course, the two antenna element conditions (deployed and stowed) illustrated in FIG. 6 cannot occur simultaneously, but are so illustrated only for explanatory purposes.

It will be noted that in FIG. 6, which represents an even-numbered bay (fourth bay "d" of FIG. 1), when rotation of drum 12 in a clockwise direction is initiated to begin stowing by retraction of the antenna elements, the elements do not rotate about their hinge pins by some amount (180° or 90°) as in FIG. 4 (1st) or FIG. 5 (3rd) bay) before beginning to be wound about the sharply curved portion of the spool. Instead, as soon as drum 12 begins to rotate from the position illustrated in FIG. 6, the antenna elements (element 40*d* is representative) immediately begin to wind about the sharply curved portion of the spool (portion 613*d* for element 40*d* in FIG. 6).

From this, it may be understood that when stowing begins from the fully deployed condition, the antenna elements of odd-numbered bays (first bay "a", third bay "c", etc.) rotate about their hinges by an angle such as 90° or 180° when the drum rotates to begin action toward stowing, while even-numbered bays begin to wind about their spools essentially immediately upon the commencement of drum rotation. As a consequence, evennumbered bays have more "winding angle" than oddnumbered bays, or in other words they may be one-quarter or one-half turn "ahead" of the odd-numbered bays. The effective spool diameters are compensated so that all elements are fully stowed at the same drum rotation. For this purpose, in the fully stowed condition all elements protrude slightly through their apertures.

Figure 7:
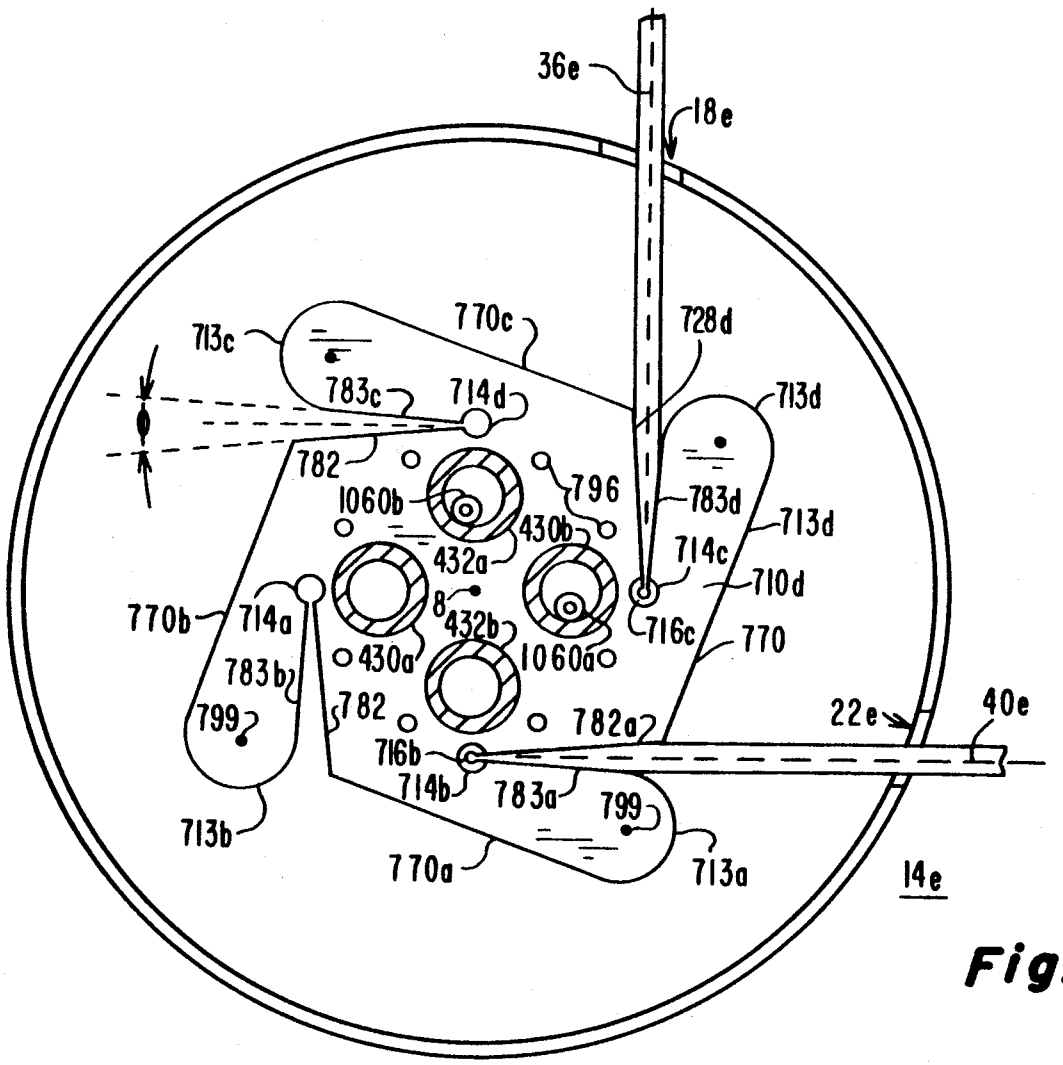

FIG. 7 illustrates spool 710 of bay 14*e*, as seen from feed end 26 of FIG. 1. The numbering convention is the same as for previous FIGURES. In FIG. 7, spool 710 is supported by tubes 430*a* and *b*, and 432*a* and *b*. Sharply curved portions 713*a–d* are each connected on one side to the adjacent notch 714*a–d* by a straight surface portion 783, as for example curve 713*c* extends by way of portion 783*c* to notch 714*d*. A straight surface 782 extends from each notch in the appropriate direction for support of the antenna element in its deployed condition, making an included angle $\phi$ with adjacent support surface 783. The direction in which the antenna element projects when supported by surfaces 782 and 783 is the bisector of angle $\phi$. As illustrated in FIG. 7, straight surfaces 782*a* and 782*d* extend from notches 714*b* and 714*c*, respectively, to provide support for antenna elements 40*e* and 36*e*, respectively. A further surface 770 joins surface 782 with curve 713, as for example surface 770*d* joins curve 713*d* with support surface 782*a* at a point below the winding path (dash line 36*e*) which antenna element 36*e* takes in the stowed condition of the antenna array.

As illustrated in FIG. 7, antenna element 36*e* extends vertically upward through aperture 18*e* in drain 12*b*, somewhat to the right of center, and antenna element 40*e* extends horizontally to the right through aperture 22*e*, somewhat below center.

Figure 8:
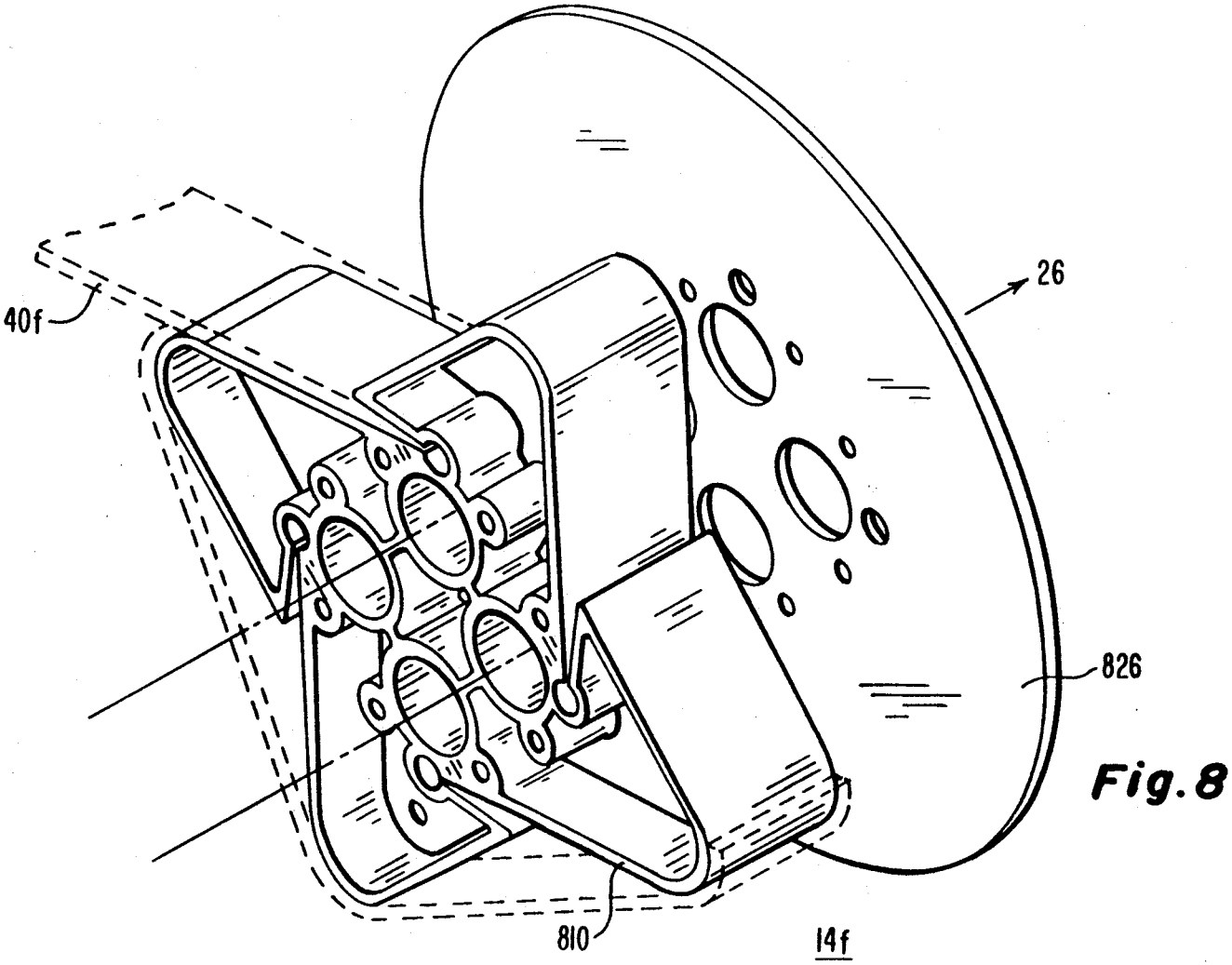
FIG. 8 is a perspective or isometric view, simplified and partially exploded, cut away and in phantom, of the sixth bay of an embodiment of the antenna of FIG. 1.

FIG. 8 illustrates spool 810 which is used for bay 14*f* of the antenna of FIG. 1, together with one flange 824. The sharply curved and straight support regions are clearly visible, but not separately designated. Antenna element 40*f* is illustrated in phantom in both the deployed and partially wound conditions. No further description is believed to be necessary, in view of the detailed description above.

Figure 9A:
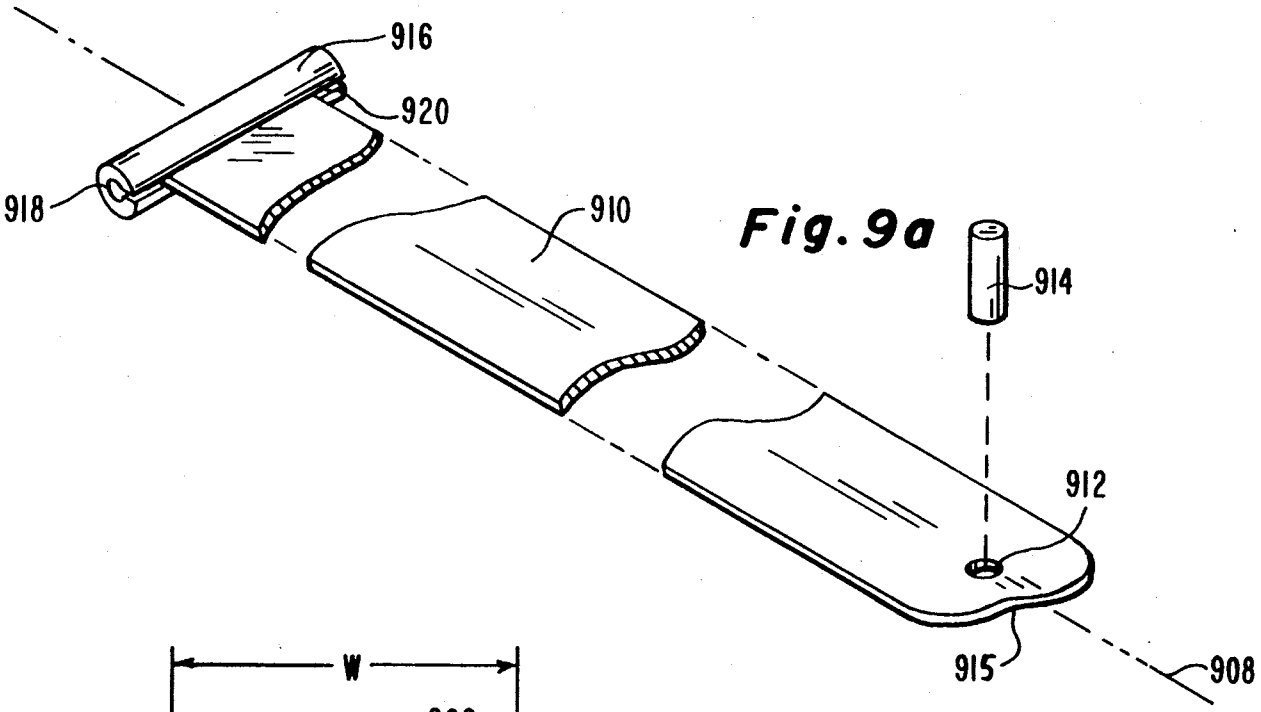
FIG. 9*a* is a perspective or isometric view of a hinge pin to which a spring antenna element according to the invention is attached, the cross-section of which element has a dual curvature (S-shaped) for improved stiffness.
Figure 9B:
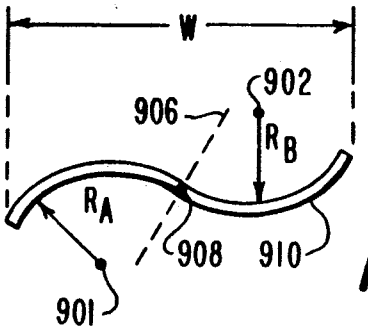
FIG. 9*b* is a cross-section of the element of FIG. 9*a* normal to its axis of elongation.

FIG. 9*a* illustrates a representative antenna element 910 which is elongated in the direction of an axis of elongation 908. An aperture 912 is formed near the free end 975 of element 910, and is dimensioned to accept a plastic retainer 914 which bottoms against the outer surface of drum 12 of the FIGURES if an attempt is made to over wind the antenna element so its end is drawn to within the interior of the drum. In a particular embodiment of the invention, antenna element 910 is formed from a one-inch wide 0.005-inch thick beryllium-copper strip. The length of the element is selected for the frequency range in question, and is ordinarily close to $\lambda/4$. The elements are pressed or stamped in a die to produce the S-shaped cross-sectional curvature illustrated in FIG. 9*b*, which for the $1\times0.005$ inch stock has a first radius of curvature $R_A$ Centered at a point 901 on one side of the stock, where $R_A$ is 0.375 inch, and which has a second like radius of curvature $R_B$ centered at a point 902 on the other side of the stock. Points 901 and 902, which are the centers of curvature for the stock, are equidistant from a plane 906 of skew-symmetry which passes through axis of elongation 908. The projected width W is reduced from 1.0 inch to 0.949 inch due to the shaping. The strips are spring tempered in the dies or molds by heating followed by slow cooling, and are then inserted into and spot welded to the slots in the hinge pins. It should be noted that the antenna element is forced to a flat condition (no curvature) where it enters the slot 920 of the hinge pin 916, and gradually assumes the S-shape with increasing distance from the hinge pin, thereby allowing a "Vee" shaped slot or guide such as that illustrated between surfaces 782*d* and 783*d* of FIG. 7 to guide an antenna element.

Figure 10A:
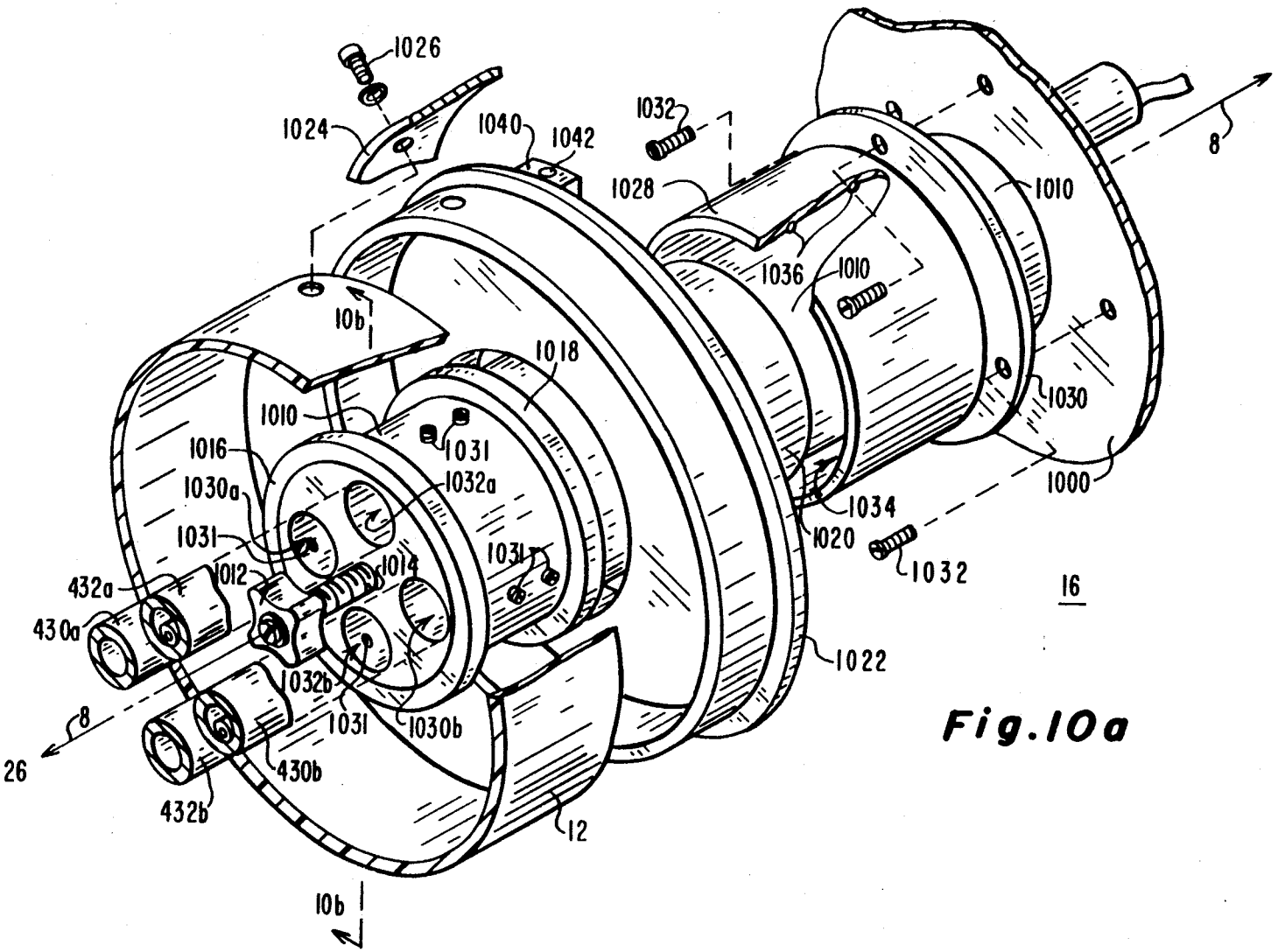
FIG. 10*a* is a simplified perspective or isometric view, partially exploded and cut away to show interior details, of the support region 16 of the antenna of FIG. 1, illustrating details of the drum rotation and damping arrangement.
Figure 10B:
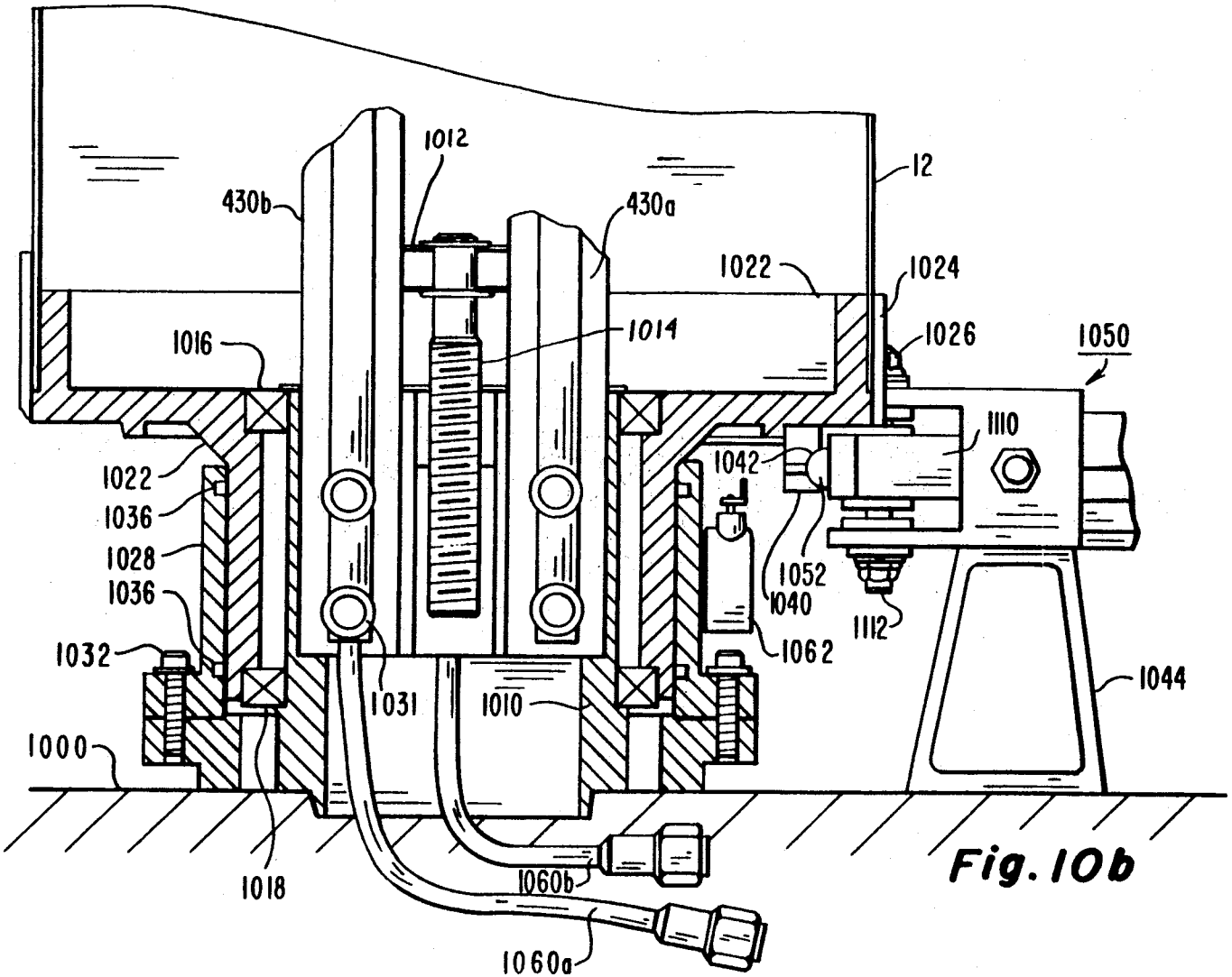
FIG. 10*b* is a section thereof taken along section lines 10*b*—10*b*, illustrating a drum locking arrangement.

FIGS. 10*a* and 10*b* together illustrate details of support structure 16 of FIG. 1. Elements of FIGS. 10*a* and 10*b* corresponding to those of the other FIGURES are designated by the same reference numerals. In FIG. 10, the support surface is designated 1000. A cylindrical spindle or shaft 1010 extends, from surface 1000, and has four apertures 1030*a* and *b* and 1032*a* and *b* extending longitudinally therethrough which are dimensioned to accept tubes 430*a* and *b*, and 432*a* and *b*, respectively. Set screws 1031 are provided for locking the tubes into the apertures. Shaft 1010 short-circuits together the exterior of tubes 430*a* and *b*, and 432*a* and *b*.

As known, the position at which the shortcircuit of the transmission lines represented by tubes 430*a* and *b* and 432*a* and *b* occurs can affect operation of the antenna. A short-circuit position adjustment is provided by a slidable short-circuiting plunger 1012, the outer surfaces of which are curved to match the curvature of the tubes, which is supported on a screw 1014 threaded into cylinder 1010 for axial motion of plunger 1012 along axis 8. The axial position of plunger 1012 can be adjusted by screw driver access from below surface 1000 to a slot (not shown) in the opposite end of screw 1014. The sliding surfaces of plunger 1012 may be provided with a spring surface such as a beryllium-copper spring (not illustrated).

A pair of annular bearings 1016, 1018 surround the end of shaft 1010. A rotary member 1020 with a flange 1022 fits over bearings 1016 and 1018, and can be rotated relative to shaft 1012. The support end of drum 12 fits over the edge of flange 1022, and is held in place by a circumferential band, a portion of which is illustrated as 1024, and a plurality of screws threaded into flange 1022, only screw 1026*y* of which is shown. Thus, the end of drum 12 near support 16 is rotatably mounted relative to tubes 430*a* and *b*, and 432*a* and *b*.

When the energy of the wound antenna elements is released to cause drum 12 to rotate to deploy the antenna, the speed of deployment may need to be controlled to avoid damage to the apparatus. Damping is provided by an annular structure 1028 with a flange 1030 which is securely fastened to support surface 1000, as by screws 1032. Annular structure 1028 of FIGS. 10*a* and 10*b* defines a bore 1034 which fits closely about the body of rotary member 1020. A pair of O-rings, the are set into annular grooves in structure 1028, and coact with annular structure 1028 and rotary member 1020 to define a closed chamber (not designated). The closed chamber is filled with a viscous fluid for damping. Those skilled in the art know that the amount of damping may be selected by controlling the spacing of the rotary and fixed members (ordinarily fixed) and by controlling the viscosity of the fluid. To maintain constant damping during excursions to low temperature extremes, heaters may be provided. A heater is illustrated as 1062 in FIG. 10B.

A pair of semi-rigid coaxial cables 1060*a* and 1060*b* extend into the support ends of tubes 430*b* and 432*a*, respectively, and extend through the tubes to feed end 26 of the tubes. The cables are provided with slight bends so that they contact the insides of the tubes to reduce stress due to vibration. The feed-end connections are described below. Cables 1060*a* and *b* provide paths by which signals may be applied to and received from the horizontally polarized and vertically polarized portions of the antenna array.

Figure 11:
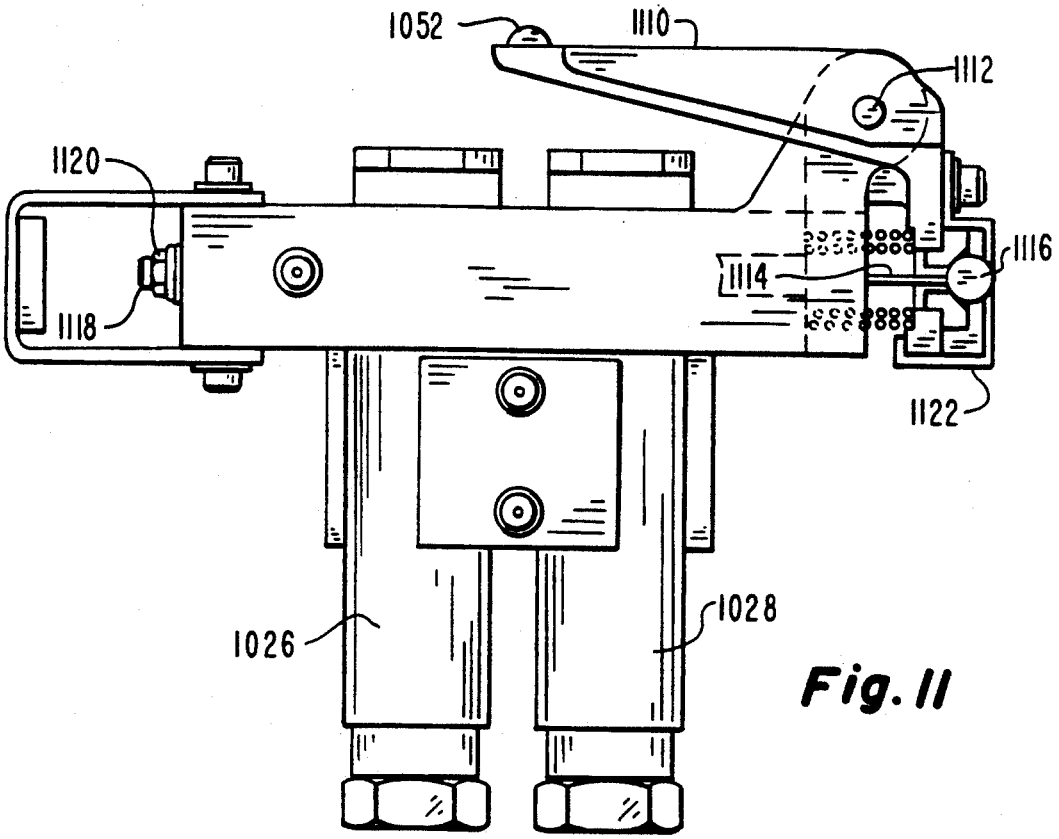
FIG. 11 illustrates details of the drum locking arrangement of FIG. 10*b*.

A bracket 1040 affixed to one side of flange 1022 has a hemispherical recess 1042 in its outer surface. Referring to FIG. 10*b*, a bracket 1044 mounted on surface 1000 supports a locking mechanism designated generally as 1050 which holds a ball 1052 within hemispherical recess 1042 to prevent rotation of flange 1022 and drum 12. Referring to FIG. 11, ball 1052 is mounted on an arm 1110 which is free to rotate about a pivot screw 1112 carrying a bracket 1122. A tensioned wire or cable 1114 extends between a tensioning screw and a terminating ball 1116 set into bracket 1122. A nut 1120 can be tightened on screw 1116 to draw wire 1114 tight, thereby pulling ball 1116, which in turn pulls on bracket 1122 to torque arm 1110 to force ball 1052 into contact with the flange (not illustrated in FIG. 11) to prevent rotation. A pair of pyrotechnic wire or cable cutters 1026 and 1028 may be fired to cut wire 1114, which allows coil springs 1030, 1032 to push bracket 1122 to thereby rotate arm 1110 about pivot 1112 and allow ball 1052 to be released from recess 1042. This in turn frees flange 1022 and drum 12 for rotation.

In operation, the antenna elements are wound about their spools in the appropriate direction by rotation of the drum. The winding continues until the elements barely protrude from their respective apertures. The locking mechanism is engaged. The antenna may then be transported and placed in location, as by assembly to a spacecraft and launch. At the appropriate time, the cable cutters are fired, whereupon the drum becomes free to rotate. The spring energy rotates the drum against the damper's resistance until full deployment occurs.

Figure 12C:
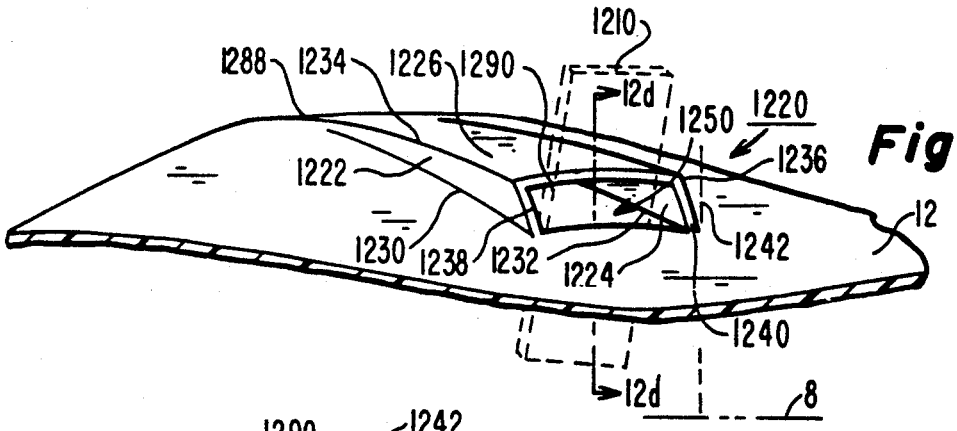
FIG. 12*c* is a perspective or isometric view of a portion of the drum including an aperture according to the invention.
Figure 12D:
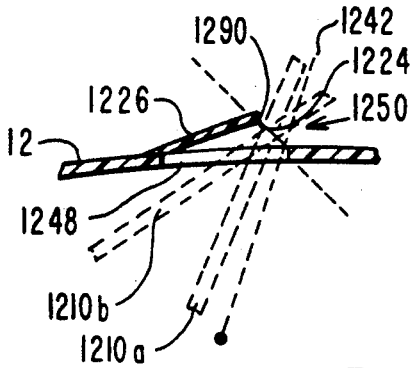
FIG. 12*d* is a cross-section of the structure of FIG. 12*c* looking along section lines 12*d*—12*d*.
Figure 12B:
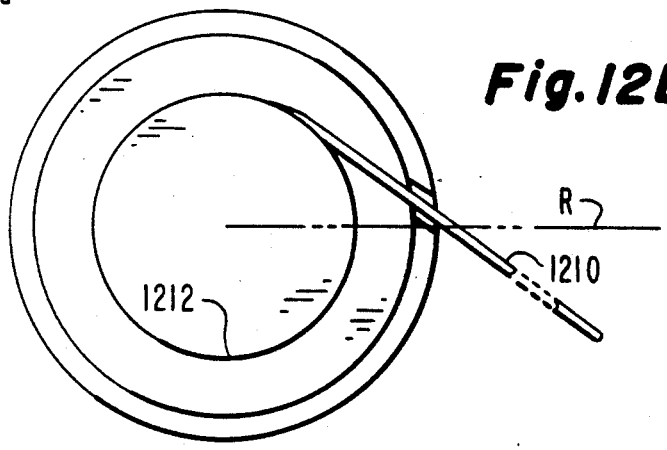
FIGS. 12*a* and 12*b* are simplified cut-away axial views of a bay of the antenna of FIG. 1 illustrating details of the angle at which an antenna element extends through an aperture in the drum.
Figure 12A:
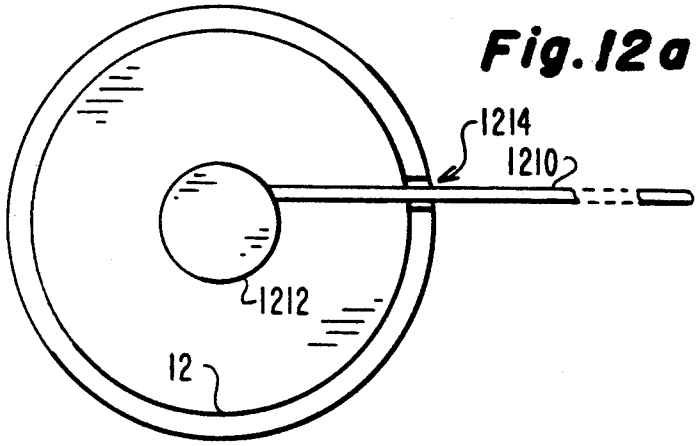

FIG. 12*a* illustrates a deployed antenna element 1210 extending from a spool 1212 having a relatively small diameter, as a result of having the antenna elements unwound therefrom. As illustrated, the antenna element projects to the right through an aperture 1214 in drum 12. The aperture must be large enough to clear the antenna element. FIG. 12*b* illustrates the same antenna element 1210 under a condition in which the antenna is almost completely stowed, whereupon the effective spool diameter is large because of all the windings thereupon. Aperture 1216 in FIG. 12*b* is more slanted relative to a radial R. The actual shape of the aperture must be such as to adapt to both these extremes of deployment condition. According to an aspect of the invention, the antenna elements exit through apertures in the drum which are not tangent to the drum surface, but which are in skew planes relative to a tangent at the point of exit.

FIG. 12*c* illustrates the general appearance of an exit aperture such as aperture 22*b* of FIG. 1. As illustrated, the exit aperture and surrounding structure has the general appearance of an "air scoop" or louver designated generally as 1220, with three distinct portions, first and second side elements 1222 and 1224 having a generally triangular shape extending above the outer surface of drum 12, and a cover element 1226 which extends from the outermost edge 1290 of aperture 1250 to a location 1288, where it is about tangent to the drum circumference at a point remote from the aperture 1250, and which is supported in place by sides 1222 and 1224. The elongated sides 1230 and 1232 of side elements 1222 and 1224, respectively, which are adjacent drum 12, are curved to match the contour of the drum, while elongated sides 1234 and 1236 of side elements 1222 and 1224, respectively, which are more distant from the outer surface of drum 12, may be either curved or straight. Sides 1222 and 1224, with cover 1226, cover a cutaway region 1248 in drum 12, and together define an aperture 1250 through which an antenna element, illustrated in phantom as 1210, can extend. The shorter sides 1238 and 1240 of side elements 1222 and 1224, respectively, do not lie along radials extending from axis 8, such as radial 1242, but are inclined relative thereto to clear antenna element 1210. FIG. 12*d* is a cross-sectional view of the structure of FIG. 12*c* looking along section lines 12*d*—12*d*. In FIG. 12*d*, cover element 1226 is seen in cross-section, and antenna element 1210 is illustrated in phantom in two positions, extending through aperture 1250.

Figure 13:
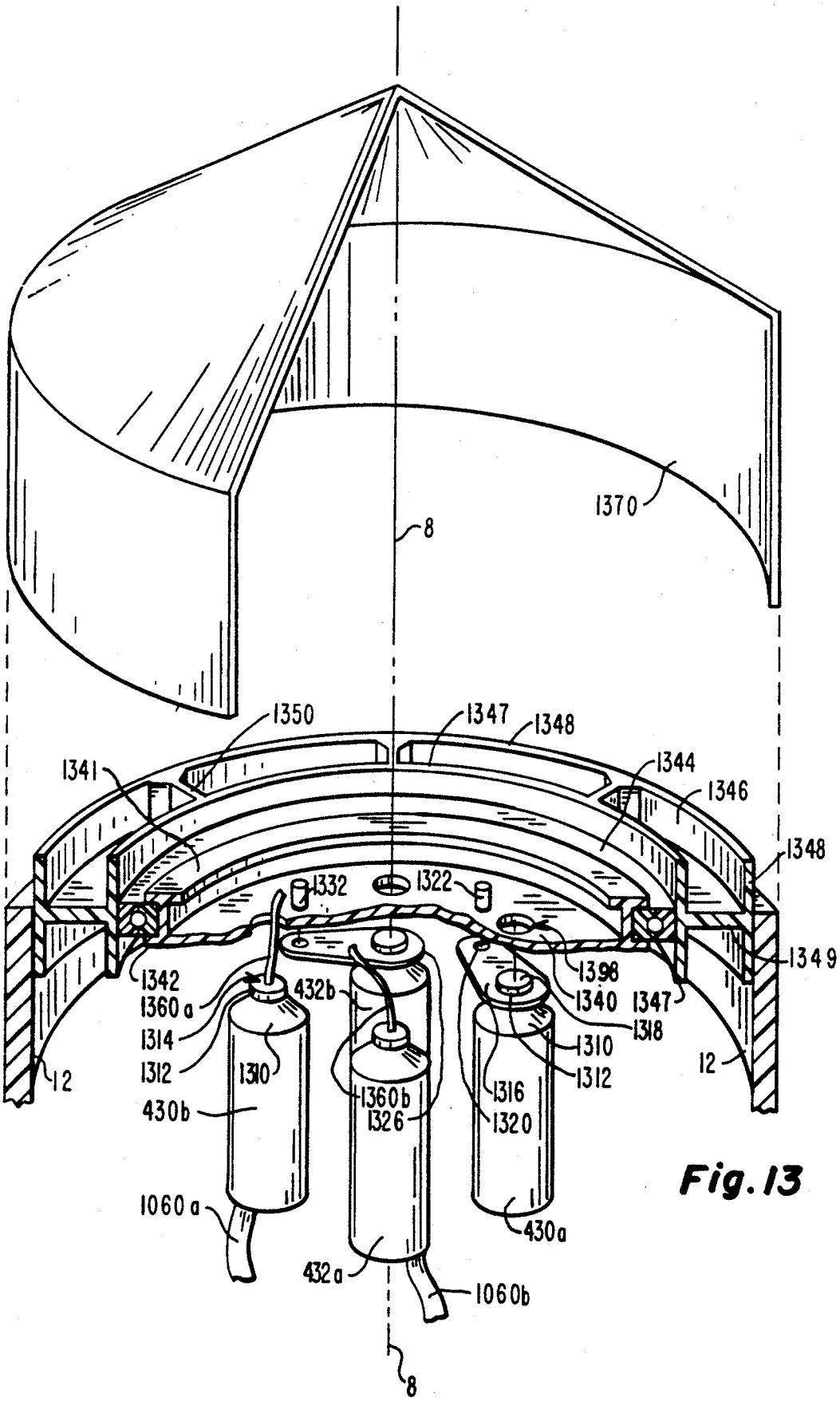
FIG. 13 is an isometric or perspective view, partially exploded and partially cut away, to reveal interior details of the feed and the drum support near the feed end of the antenna of FIG. 1.

In FIG. 13, elements corresponding to those of FIGS. 3–12 are designated by the same reference numerals. A conductive truncated conical structure illustrated as 1310 caps each of the tubes 430*a* and *b* and 432*a* and *b*. Each conical structure 1310 includes a raised threaded collar, one of which is designated 1312. Each conical structure 1310 also defines a through hole, one of which is designated 1314, adapted for clearance of the inner conductor of a coaxial cable. The outer conductors (not separately designated) of coaxial cables 1060*a* and 1060*b* are connected to the peripheries of their apertures 1314 to thereby electrically connect the outer conductor to the associated tube. The inner conductor, with its insulation intact, extends through its aperture 1314. The inner conductor of coaxial cable 1060*a* is designated 1360*a*, and the inner conductor of coaxial cable 1060*b* is designated 1360*b*. As is well known in the art, a balanced-to-unbalanced converter (balun) is formed by an electrical connection of center conductor 1360*a* extending from tube 430*b* to tube 430*a*, and the balun avoids undesirable unbalances when driving a symmetrical structure from an unbalanced transmission line such as a coaxial cable.

The electrical connections are facilitated by a first electrically conductive link 1316, which has an aperture 1318 at one end which fits over collar 1312 of conical structure 1310 of tube 430*a*. At the other end of link 1316, a hole 1320 accepts a binding post or connector 1322. Connector 1322 is adapted for accepting center conductor 1360*a*, to thereby make the connection completing the balun for one transmission line. A second balun is formed by the combination of a second lug 1326, which fits over and is connected to the collar of the conical structure 1310 associated with tube 432*b*, together with a connector 1332 which fits into a hole in lug 1326, and which accepts center conductor 1360*b*.

An end support plate 1340 in FIG. 13 defines four apertures 1398 (not all of which are visible in FIG. 13), which fit over the four collars 1312 of the conical structures, and over lugs 1318 and 1326. A pair of washers (not illustrated) are placed over the collars which are not associated with lugs 1318 or 1326 to equalize height. A nut (not illustrated) is threaded onto each collar to hold support plate 1340 in position. Support plate 1340 aids in supporting lugs 1316 and 1326, and connectors 1322 and 1332.

End support plate 1340 of FIG. 13 has a peripheral or annular flange 1342 which defines a channel which supports one side of a radial bearing 1344. A retaining member 1341 fits over the bearing and end support plate, and is fastened by means (not illustrated) to retain it in position. Thus, support plate 1340 and retaining member 1341, and the inner race of bearing 1344 are fixed to tubes 430*a* and *b* and 432*a* and *b*. The outer race (not separately designated) of bearing 1344 is free to rotate. While bearing 1344 is an electrically conductive structure, it is relatively small by comparison with a wavelength, and does not excessively perturb the antenna characteristics.

A nonconductive outer support ring 1346 in the form of an annular I-beam includes inner and outer flanges 1347 and 1348, respectively, and a web 1349. Additional supports such as 1350 provide stiffness. The feed end of drum 12 is fastened to outer flange 1348 and, together with bearings 1016 and 1018 of FIG. 10, allows drum 12 to rotate freely under the impetus of the force imparted by the coiled antenna elements. A protective end cap 1370 is dimensioned to fit over flange 1348 and to be fastened thereto. End cap 1370, together with drum 12, provides a continuous shroud around the active portion of the antenna, except for the drum apertures through which the antenna elements protrude. The shape of end cap 1370 may be adapted to be retained in the hold of a spacecraft.

In a particular embodiment of the invention, a location forward of support plate 1340, within end cap 1370, was found to be advantageous for the location of a multiturn potentiometer (not illustrated) used to provide an indication of drum rotational position. The potentiometer was mounted on support plate 1340 with its shaft coaxial with axis 8, and with a simple radial element providing mechanical connection between the potentiometer shaft and a rotational portion, such as flange 1347, to thereby cause the shaft to move in concert with drum 12.

Other embodiments of the invention will be apparent to those skilled in the art. For example, the antenna elements may have conductive top or end caps which are configured to match the outer curvature of drum 12, and which also prevent the elements from being retracted to within the drum. Instead of having all the elements driven as in a log-periodic dipole, some of the extensible elements may merely be interconnected internally to form short-circuited dipoles, which may be operated as reflectors or directors in known fashion, in conjunction with other driven elements; as an example, in a YAGI antenna which uses a plurality of spaced-apart directors in the form of short-circuited dipole elements, wherein each director is slightly shorter than the driven dipole. The outer surface of the drum may be coated with light-reflective coatings for thermal control in the environment of a spacecraft, and/or may be coated with a slightly conductive material such as indium-tin oxide or conductive paint to aid in dissipating charge which may accumulate due to fluence of charged particles. The antenna elements may be electrically insulated from such a coating. In a particular embodiment of the invention, type MH55IC paint may be used. It is manufactured by Illinois Institute of Technology Research Institute, 10 West 35th Street, Chicago, Ill. For space applications, fasteners may need to be locked against vibration, and particular materials may be required for light weight, reliability, prevention of outgassing, and the like, all of which are within ordinary skill in the art. The hinge joints and bearings may be lubricated, as by BRAY 601 perfluorinated grease. While the spools have been described as having regions of small radius of curvature connected by regions of large radius of curvature, the regions of large radius of curvature need only have large average radius of curvature, but may include or be made up of regions of very small radius of curvature.

What is claimed is:

1. A deployable antenna, comprising:

a feed structure including a two-conductor transmission line including first and second conductors extending parallel to a first axis;

an elongated first antenna element defining first and second ends, said first antenna element being adjacent a first location along said transmission line, said first end of said first antenna element being electrically connected to said first conductor of said transmission line, said first antenna element being made from a spring material having its lowest energy state when said antenna element is in a deployed state, whereupon a longitudinal dimension of said first antenna element, extending between said first and second ends, is straight;

an elongated second antenna element defining first and second ends, said second antenna element being adjacent a second location along said transmission line, said first end of said second antenna element being electrically connected to said second conductor of said transmission line, said second element being made from a spring material having its lowest energy state when said second antenna element is in a deployed state, whereupon a longitudinal dimension of said second antenna element, extending between said first and second ends, is straight;

first and second spools coaxial with said first axis and adjacent said first and second locations, respectively, said first and second spools being adapted for, in an stowed state of the antenna, having said first and second antenna elements, respectively, wound thereabout in the same direction in a state in which energy is stored in the spring material of the elements; and a single drum coaxial with and surrounding said first and second spools, said drum including first and second apertures adjacent said first and second locations, said second ends of said first and second antenna elements extending through said first and second apertures, respectively, whereby said energy stored in said spring elements tends to rotate said drum in a direction which simultaneously unwinds and deploys said first and second antenna elements from said first and second spools, respectively.

2. An antenna according to claim 1 wherein said first and second antenna elements are of different lengths, and in order to fully deploy said first and second antenna elements to their full lengths, the effective diameters of said first and second spools are different.

3. An antenna according to claim 1 wherein, in the fully deployed state of said antenna, said first and second antenna elements have parallel axes of elongation, and said parallel axes of elongation lie on opposite sides of a plane parallel to said axes of elongation and passing through said first axis.

4. An antenna according to claim 1 further comprising an elongated third antenna element defining first and second ends, said third antenna element being adjacent said first location along said transmission line, said first end of said third antenna element being electrically connected to said second conductor of said transmission line, said third element in its deployed state having its axis of elongation extending parallel to the axis of elongation of said first element, said third antenna element when fully deployed lying principally on one side of a plane which is orthogonal to said axes of elongation and which includes said first axis, while said first antenna element lies principally on the other side of said plane.

5. An antenna according to claim 4 further comprising:

a second feed structure including a second two-conductor transmission line including first and second conductors, said second transmission line being coaxial with said first mentioned transmission line and orthogonal thereto;

an elongated fourth antenna element defining first and second ends, said fourth antenna element being adjacent said first location, said first end of said fourth antenna element being electrically connected to said first conductor of said second transmission line, said fourth antenna element, when fully deployed, defining an axis of elongation which is about perpendicular to lines parallel to both said first axis and said axes of elongation of said first and third antenna elements; and an elongated fifth antenna element defining first and second ends, said fifth antenna element being adjacent said first location, said first end of said fifth antenna element being electrically connected to said second conductor of said second transmission line, said fifth antenna element, when fully deployed, defining an axis of elongation which is about parallel to said fourth antenna element, said fifth antenna element, when fully deployed, being on the other side of a first plane relative to said fourth antenna element., said first plane including said first axis and being about orthogonal to said axes of elongation of said fourth and fifth antenna elements.

6. A deployable antenna, comprising:

a feed structure including a two-conductor transmission line including first and second conductors extending parallel to a first axis;

an elongated first antenna element defining first and second ends, said first antenna element being adjacent a first location along said transmission line, said first end of said first antenna element being electrically connected to said first conductor of said transmission line, said first antenna element being made from a spring material having its lowest energy state when said antenna element is in a deployed state, whereupon a longitudinal dimension of said first antenna element, extending between said first and second ends, is straight;

an elongated second antenna element defining first and second ends, said second antenna element being adjacent a second location along said transmission line, said first end of said second antenna element being electrically connected to said second conductor of said transmission line, said second element being made from a spring material having its lowest energy state when said second antenna elements is in a deployed state, whereupon a longitudinal dimension of said second antenna element, extending between said first and second ends, is straight;

first and second spools coaxial with said first axis and adjacent said first and second locations, respectively, said first and second spools being adapted for, in an stowed state of the antenna, having said first and second antenna elements, respectively, wound thereabout in the same direction in a state in which energy is stored in the spring material of the elements;

a drum coaxial with and surrounding said first and second spools, said drum including first and second apertures adjacent said first and second locations, said second ends of said first and second antenna elements extending through said first and second apertures, respectively, whereby said energy stored in said spring elements tends to rotate said drum in a direction which simultaneously unwinds and deploys said first and second antenna elements from said first and second spools, respectively; and wherein said antenna elements have a natural radius of curvature, and at least one of said spools has a cross-section including plural curved portions having said natural radius of curvature and additional portions between said curved portions which have a greater radius of curvature.

7. An antenna according to claim 6 wherein the number of said plural curved portions is four.

8. A deployable antenna, comprising:

a feed structure including a two-conductor transmission line including first and second conductors extending parallel to a first axis;

an elongated first antenna element defining first and second ends, said first antenna element being adjacent a first location along said transmission line, said first end of said first antenna element being electrically connected to said first conductor of said transmission line, said first antenna element being made from a spring material having its lowest energy state when said antenna element is in a deployed state, whereupon a longitudinal dimension of said first antenna element, extending between said first and second ends, is straight;

an elongated second antenna element defining first and second ends, said second antenna element being adjacent a second location along said transmission line, said first end of said second antenna element being electrically connected to said second conductor of said transmission line, said second element being made from a spring material having its lowest energy state when said second antenna element is in a deployed state, whereupon a longitudinal dimension of said second antenna element, extending between said first and second ends, is straight;

first and second spools coaxial with said first axis and adjacent said first and second locations, respectively, said first and second spools being adapted for, in an stowed state of the antenna, having said first and second antenna elements, respectively, wound thereabout in the same direction in a state in which energy is stored in the spring material of the elements;

a drum coaxial with and surrounding said first and second spools, said drum including first and second apertures adjacent said first and second locations, said second ends of said first and second antenna elements extending through said first and second apertures, respectively, whereby said energy stored in said spring elements tends to rotate said drum in a direction which simultaneously unwinds and deploys said first and second antenna elements from said first and second spools, respectively; and wherein at least one of said antenna elements is a thin, elongated member which defines an axis of elongation in its fully deployed condition, and has a cross-section perpendicular to said axis of elongation which has a bipartite curvature, one portion of which is centered on a first side of said thin member, and a second portion of which is centered on the second side of said thin member.

9. A deployable antenna, comprising:

a feed structure including a two-conductor transmission line including first and second conductors extending parallel to a first axis;

an elongated first antenna element defining first and second ends, said first antenna element being adjacent a first location along said transmission line, said first end of said first antenna element being electrically connected to said first conductor of said transmission line, said first antenna element being made from a spring material having its lowest energy state when said antenna element is in a deployed state, whereupon a longitudinal dimension of said first antenna element, extending between said first and second ends, is straight;

an elongated second antenna element defining first and second ends, said second antenna element being adjacent a second location along said transmission line, said first end of said second antenna element being electrically connected to said second conductor of said transmission line, said second element being made from a spring material having its lowest energy state when said second antenna element is in a deployed state, whereupon a longitudinal dimension of said second antenna element, extending between said first and second ends, is straight;

first and second spools coaxial with said first axis and adjacent said first and second locations, respectively, said first and second spools being adapted for, in an stowed state of the antenna, having said first and second antenna elements, respectively, wound thereabout in the same direction in a state in which energy is stored in the spring material of the elements;

a drum coaxial with and surrounding said first and second spools, said drum including first and second apertures adjacent said first and second locations, said second ends of said first and second antenna elements extending through said first and second apertures, respectively, whereby said energy stored in said spring elements tends to rotate said drum in a direction which simultaneously unwinds and deploys said first and second antenna elements from said first and second spools, respectively; and wherein at least one of said first and second antenna elements is mechanically connected at one end thereof to its associated spool by a hinge, whereby winding rotation of said drum near the fully deployed condition of said antenna causes said one of said elements to rotate on said hinge while the other of said first and second antenna elements does not rotate about a hinge but instead winds about the associated spool.

10. An antenna according to claim 9 wherein said hinge comprises a hinge pin, and said first end of one of said first and second antenna elements is connected to said hinge pin.

11. An antenna according to claim 10 wherein said hinge pin is enabled for rotation in a pair of bushings.

12. An antenna according to claim 11 wherein said bushings are electrically nonconductive.

13. An antenna according to claim 12 further comprising an elongated flexible electrical conductor connected to said hinge pin and to one of said first and second conductors of said transmission line.

14. A deployable antenna, comprising:

a feed structure including a two-conductor transmission line including first and second conductors extending parallel to a first axis;

an elongated first antenna element defining first and second ends, said first antenna element being adjacent a first location along said transmission line, said first end of said first antenna element being electrically connected to said first conductor of said transmission line, said first antenna element being made from a spring material having its lowest energy state when said antenna element is in a deployed state, whereupon a longitudinal dimension of said first antenna element, extending between said first and second ends, is straight;

an elongated second antenna element defining first and second ends, said second antenna element being adjacent a second location along said transmission line, said first end of said second antenna element being electrically connected to said second conductor of said transmission line, said second element being made from a spring material having its lowest energy state when said second antenna element is in a deployed state, whereupon a longitudinal dimension of said second antenna element, extending between said first and second ends, is straight;

first and second spools coaxial with said first axis and adjacent said first and second locations, respectively, said first and second spools being adapted for, in an stowed state of the antenna, having said first and second antenna elements, respectively, wound thereabout in the same direction in a state in which energy is stored in the spring material of the elements;

a drum coaxial with and surrounding said first and second spools, said drum including first and second apertures adjacent said first and second locations, said second ends of said first and second antenna elements extending through said first and second apertures, respectively, whereby said energy stored in said spring elements tends to rotate said drum in a direction which simultaneously unwinds and deploys said first and second antenna elements from said first and second spools, respectively;

wherein each of said apertures lies in a plane which, at the location of said aperture, is skewed relative to a plane tangent to the outer surface of said drum, also at the location of said aperture; and wherein said drum includes a raised portion extending from the outermost edge of said aperture to a generally cylindrical surface contiguous with the innermost edge of said aperture.

15. A method for stowing, transporting and deploying an antenna including an apertured drum surrounding and coaxial with first and second axially displaced spools, and also including first and second elongated spring material antenna elements, each fastened at one end to a corresponding one of said spools and extending through a corresponding aperture in said drum, comprising the steps of:

applying energy to rotate said drum coaxial with said spools to thereby wind said first and second antenna elements onto said first and second spools, respectively, whereby energy is stored in said spring material of said first and second antenna elements;

locking said drum against rotation relative to said spools;

transporting said antenna with said drum locked against rotation; and following said transporting step, unlocking said drum, whereby the energy stored in said antenna elements rotates said drum and causes said first and second antenna elements to deploy by unwinding from said first and second spools, respectively.

16. A method for stowing, transporting and deploying an antenna including an apertured drum surrounding and coaxial with first and second axially displaced spools, and also including first and second elongated spring material antenna elements, each fastened at one end to a corresponding one of said spools and extending through a corresponding aperture in said drum, comprising the steps of:

applying energy to rotate said drum coaxial with said spools to thereby wind said first and second antenna elements onto said first and second spools, respectively, whereby energy is stored in said spring material of said first and second antenna elements;

locking said drum against rotation relative to said spools;

transporting said antenna with said drum locked against rotation; and following said transporting step, unlocking said drum, whereby the energy stored in said antenna elements rotates said drum and causes said first and second antenna elements to deploy by unwinding from said first and second spools, respectively;

viscously damping said rotation of said drum.

* * * * *